US011999397B2

(12) United States Patent
Pickard et al.

(10) Patent No.: US 11,999,397 B2
(45) Date of Patent: Jun. 4, 2024

(54) SYSTEM AND METHOD FOR RAILROAD DIRECTIVE MANAGEMENT

(71) Applicant: BNSF Railway Company, Fort Worth, TX (US)

(72) Inventors: Christopher Neil Pickard, Argyle, TX (US); Kyle Keilty Williams, Fort Worth, TX (US); Gregory Harrison, Fort Worth, TX (US); James Helm, Fort Worth, TX (US)

(73) Assignee: BNSF Railway Company, Fort Worth, TX (US)

( * ) Notice: Subject to any disclaimer, the term of this patent is extended or adjusted under 35 U.S.C. 154(b) by 13 days.

(21) Appl. No.: 17/819,475

(22) Filed: Aug. 12, 2022

(65) Prior Publication Data

US 2023/0084425 A1 Mar. 16, 2023

Related U.S. Application Data

(63) Continuation of application No. 17/473,484, filed on Sep. 13, 2021, now Pat. No. 11,453,423.

(51) Int. Cl.
*B61L 27/16* (2022.01)
*B61L 25/06* (2006.01)

(52) U.S. Cl.
CPC ..... *B61L 27/16* (2022.01); *B61L 25/06* (2013.01)

(58) Field of Classification Search
None
See application file for complete search history.

(56) References Cited

U.S. PATENT DOCUMENTS 10,643,500 B2 5/2020 Jovenall
2002/0077733 A1* 6/2002 Bidaud ..... B61L 23/047 73/146

(Continued)

FOREIGN PATENT DOCUMENTS

GB 1044728 A 10/1966

OTHER PUBLICATIONS

PCT/US2022/03847, filed Jul. 27, 2022; Partial Search Report and Written Opinion, dated Nov. 23, 2022, 13 pages.

(Continued)

*Primary Examiner* — Adam D Tissot
(74) *Attorney, Agent, or Firm* — Whitaker Chalk Swindle & Schwartz, PLLC; Enrique Sanchez, Jr.; Juan Vasquez

(57) ABSTRACT

A system for railroad directive management is presented. The system can receive a myriad of data related to a directive, track segments, and/or vehicle events on the track and/or track segments. Vehicle- and/or event-specific data can be compared with one or more thresholds, including force thresholds, temporal thresholds, environmental thresholds, and/or event thresholds to determine whether and what kind of directive modification should be instantiated. Specialized algorithms can be implemented to trace vehicle paths along the track to determine whether directive-related segments are traversed, and specialized clustering algorithms can be utilized to cluster data unique to a particular segment on a per-segment basis. The system can be integrated with existing track infrastructure and can further generate alerts to notify coupled systems and/or personnel of directives and/or modification thereof.

20 Claims, 15 Drawing Sheets

(56) References Cited

U.S. PATENT DOCUMENTS

| | | | | |
|---|---|---|---|---|
| 2012/0203402 | A1 | 8/2012 | Jape et al. | |
| 2014/0277824 | A1 | 9/2014 | Kernwein et al. | |
| 2016/0318532 | A1* | 11/2016 | Brooks | B61L 27/16 |
| 2017/0115166 | A1* | 4/2017 | Bartonek | G01J 5/10 |
| 2021/0078622 | A1 | 3/2021 | Miller et al. | |
| 2021/0304095 | A1 | 9/2021 | Smith et al. | |

OTHER PUBLICATIONS

International Patent Appl. No. PCT/US2022/038487, International Search Report and Written Opinion, dated Mar. 3, 2023, 24 pages.

* cited by examiner

SYSTEM AND METHOD FOR RAILROAD DIRECTIVE MANAGEMENT

CROSS-REFERENCE TO RELATED APPLICATIONS

The present application is a Continuation application of U.S. patent application Ser. No. 17/473,484, filed Sep. 13, 2021, the contents of which are incorporated herein in their entirety for all purposes.

TECHNICAL FIELD

The present disclosure relates generally to managing directives, such as slow orders, in railroad infrastructure, such as with respect to directives instated due to ballast disturbance.

BACKGROUND

Rail transport systems traverse entire continents to enable the transport and delivery of passengers and goods throughout the world. A quintessential component of railroad infrastructure is the track—laid over a myriad of geographies and terrains, railroad tracks are designed to withstand the worst of the elements and facilitate disbursement of locomotives throughout the railroad system. Because of this constant exposure of the tracks to hazardous conditions, railroad companies must be vigilant in maintaining track integrity; if a section of track is compromised and the damage or obstruction is not quickly addressed, the consequences can be catastrophic.

The general structure of a track can include several components. Generally, a foundation referred to as the ballast, often made up crushed stone, gravel, or other aggregate, provides a compacted pathway on which the track can be laid; on top of the ballast are the rails and ties. Rails afford an actual surface on which rail vehicle wheels can roll. The rails run parallel with one another for thousands of miles, and the wheel-span of rail vehicles are specially designed and sized to match the track footprint. If rails were to separate laterally, the results would be disastrous. As such, to maintain a consistent and uniform distance between the rails, lateral slat-like components called ties are disposed between and coupled to the rails. The ties can be wood, concrete, or any other suitable material, and the ties can be secured to or within the ballast to facilitate track stability. The ties serve the very important purpose of helping maintain lateral tension between the rails, such that the extreme weight of rail traffic does not lead to rail separation.

While ties play a role in maintaining lateral tension, another key component is the ballast. Compact of the ballast around the rail components greatly enhance rail stability, especially with respect to maintaining lateral rail tension. The ballast is compacted by the millions or billions of pounds that continuously travel on the rails which the ballast supports. When track maintenance work that disturbs the compaction of the ballast section (tie replacement, surfacing, etc.) is performed, the integrity of the track at that location can be compromised such that full-speed trains should not travel over that area. For example, locations with under-compacted ballast sections have a higher risk of the track structures (e.g., ties and rails) moving out of alignment due to various conditions (temperature, longitudinal forces, braking forces, etc.). To avoid misalignment of track structures, a speed restriction and/or other directive, often called a "slow order," can be placed on the particular length of track with a disturbed ballast. A "slow order" is a temporary speed restriction applied to train operations meant to protect crews, trains, freight, facilities, and the general public from train derailments due to a known or potential substandard track condition.

However, such caution with respect to track integrity must be balanced with train throughput, as efficiency in the railroad system is also a chief concern. Trains operating at slower speeds reduce velocity of the network. Impacts of slow orders can be measured in delay minutes, which can be based on the slow order speed compared to the maximum authorized speed if no slow order were instated.

SUMMARY

The present disclosure achieves technical advantages as a system and method for directive management with respect to railroad infrastructure. The system can account a plurality of events occurring on one or more track segments and compare event data with one or more event thresholds to determine how such event should be treated for the purposes of directive modification or removal. The system can further implement segment-specific data clustering to generate segment-specific descriptors that can be passed to thresholding logic of the system, allowing the system to account for each segment in a directive area to be individually addressed in determining directive modification. The system can receive data points that can be generated via an electrical current in a railroad track (and/or disturbance thereof) and utilize such data points to identify track segments on which a vehicle is travelling or has traveled, and further implement such data points in tracing logic to determine a vehicle path that can enable the system to recognize if a vehicle has traversed a track segment from which no data point was received by the system. The system achieves an significant technical advantage in that the plurality of data and transformation thereof can provide an automated directive modification tool based on one or more thresholds, such as force thresholds, temporal thresholds, and/or event thresholds, that can modify a directive upon satisfaction or such thresholds and thereby substantially increase train throughput on a given railroad track.

The present disclosure solves the technological problem of enhancing train throughput while accounting for directives by enabling the modification of such directives based on the occurrence of a particular number of events meeting particular event criteria that can be specific to a given directive, effectively tailoring a given directive in real-time to ensure maximum throughput at areas of the track affected by one or more directives. The present disclosure can receive directive data, associate the data with one or more individual track segments, determine a vehicle path, determine if such path traverses a segment, maintain a segment-specific data cluster, compare such cluster with one or more thresholds (including force, event, and/or temporal thresholds), determine how a directive should be modified based on the result of the cluster/threshold comparison, and instantiate such directive modification.

The present disclosure improves the performance and functionality of the system by implementing specialized algorithms adapted to receive, utilize, and generate data related to directives, associated track segments, and vehicle path traverses such segments. The system can implement tracing algorithms to elucidate vehicle paths from somewhat incomplete data, e.g., when contiguous track segments fail to detect vehicle presence such that data points are discontinuous. The system can further be integrated with existing track infrastructure and systems to provide meaningful alerts, notifications, and data regarding events and related directives. The system provides a meaningful and extremely advantageous use for "big data," e.g. data generated with respect to multiple areas and faucets of railroad operation, such as by transforming the received data and implementing such transformed data in specialized algorithms to generate segment-specific clusters to maximize both safety and efficiency of railroad operation.

The disclosed railroad directive management system can include a server in operable communication with a database, clients, a positive train control system, and/or a train management and dispatch system. The railroad directive management system can further be in operable connection with a plurality of sensors, gauges, receivers, transceivers, cameras, sirens, speaker, lights, or any other suitable devices or mechanisms designed to detect vehicles, measure distance, position, location, and/or capture and/or receive data related to a track and/or vehicle. The railroad directive management system can generate records containing relevant data, including directive data, vehicle data, segment clusters, thresholds, timestamps, vehicle identity, vehicle velocity, vehicle direction, work time and date, time and date of threshold satisfaction, division data, and/or any other relevant data.

It is an object of the disclosure to provide a system for providing a meaningful use for mass data by generating one or more directive modifications and/or alerts related to such modifications. It is a further object of the disclosure to provide a method for instating, modifying, and removing directives based on track and/or directive and/or segment-specific data. These and other objects are provided by at least the following embodiments.

In one embodiment, the present disclosure can include a system for monitoring track segment forces in railroad tracks, comprising: a memory having a first database with a plurality of data, thresholds, and specifications related to railroad tracks and at least one asset; and a computer processor operably coupled to the memory and capable of executing machine-readable instructions to perform program steps, the program steps including: receiving directive data and track data related to a track; identifying, via the processor, a plurality of track segments associated with the track data; associating the directive data with at least a first track segment; identifying an asset disposed on the track; receiving asset data and positional data points related to the asset; calculating a path of the asset along the track using the positional data points; determining if the path or at least one of the positional data points traverses the first track segment; generating, via the processor, a first segment data cluster having the asset data associated with the first track segment, if the path or at least one of the positional data points traverses the first track segment; calculating a total force applied to the first track segment using the first segment data cluster; determining, using at least the first total force, a minimum total force; generating a first alert if the minimum total force satisfies a force threshold. Wherein the program steps further include associating the directive data with a second track segment of the plurality of track segments. Wherein the program steps further include: including the asset data in a second segment data cluster associated with the second track segment if the path traverses the second track segment. Wherein the program steps further include: calculating a second total force applied to the second track segment using the second segment data cluster; comparing the first total force with the second total force; and determining a second minimum total force using the first total force and the second total force. Wherein the program steps further include instantiating a first directive modification if the minimum total force satisfies a force threshold. Wherein the program steps further include assigning an identifier to each of the plurality of track segments. Wherein the directive data includes a slow order. Wherein the first directive modification includes abrogating the slow order. Wherein the directive data includes a compaction slow order. Wherein the program steps further include receiving a timestamp. Wherein the program steps further include generating a second alert if the timestamp satisfies a first temporal threshold. Wherein the program steps further include instantiating a directive modification if the timestamp satisfies a first temporal threshold.

In another embodiment, the present disclosure can include a system for governing directives related to a railroad, comprising: a memory having a first database with a plurality of data, thresholds, and specifications related to railroad tracks and at least one asset; and a computer processor operably coupled to the memory and capable of executing machine-readable instructions to perform program steps, the program steps including: receiving directive data and track data related to a track; identifying, via the processor, a plurality of track segments associated with the track data; associating the directive data with at least a first track segment of the plurality of track segments; determining a first event criterion related to at least the first track segment; identifying an asset disposed on the track; receiving asset data and positional data points related to the asset; calculating a path of the asset along the track using the positional data points; determining if the path or at least one of the positional data points traverses the first track segment; comparing the asset data to the first event criterion if the path or at least one of the positional data points traverses the first track segment; incrementing a first event count associated with the first track segment if the asset data satisfies the first event criterion; determining, using at least the first event count associated with the first track segment, a minimum first event count; generating a first alert if the minimum first event count satisfies a first event threshold. Wherein the first event criterion includes a first velocity threshold. Wherein the program steps further include associating the directive data with a second track segment of the plurality of track segments. Wherein the program steps further include: if the path traverses the second track segment: comparing the asset data to the first event criterion; and incrementing a first event count associated with the second track segment if the asset data satisfies the first event criterion. Wherein the program steps further include: comparing the first event counts associated with the first and second track segments; and determining the minimum first event count using at least the first event count associated with the first track segment and the first event count associated with the second track segment. Wherein the program steps further include determining a second event criterion. Wherein the program steps further include comparing the asset data to the second event criterion if the path or at least one of the positional data points traverses the first track segment and if the minimum first event count satisfies the first event threshold. Wherein the program steps further include incrementing a second event count associated with the first track segment if the asset data satisfies the second event criterion. Wherein the program steps further include determining a minimum second event count using at least the second event count associated with the first track segment. Wherein the second event criterion includes a second velocity threshold. Wherein the program steps further include instantiating a directive modification if the minimum first event count satisfies a first event threshold. Wherein the directive modification includes modifying a slow order. Wherein the program steps further include generating a second alert if the minimum second event count satisfies a second event threshold. Wherein the asset is a train.

In another embodiment, the present disclosure can include a method of compensating for environmental conditions in managing directives related to a railroad, the method comprising the steps of: receiving, via an encrypted network, directive data and track data related to a track; identifying, via the processor, a plurality of track segments associated with the track data; associating the directive data with at least a first track segment of the plurality of track segments; identifying an asset disposed on the track; receiving asset data and positional data points related to the asset; receiving environmental data; determining a plurality of event criteria; calculating, via a processor, a path of the asset along the track using the positional data points; determining if the path or at least one of the positional data points traverses the first track segment; determining, via the processor, that the environmental data satisfies a first environmental threshold if the path or at least one of the positional data points traverses the first track segment; comparing the asset data with a first event criterion of the plurality of event criteria if the environmental data satisfies the first environmental threshold; incrementing a first event count associated with the first track segment if the asset data satisfies the first event criterion; and instantiating a first directive modification if the first event count associated with the first track segment satisfies a first event threshold. Further comprising the step of comparing the asset data with a second event criterion of the plurality of event criteria if the first event threshold is satisfied. Further comprising the steps of: incrementing a second event count associated with the first track segment if the asset data satisfies the second event criterion; and instantiating a second directive modification if the second event count associated with the first track segment satisfies a second event threshold. Wherein the environmental threshold is a temperature threshold.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

The preferred version of the disclosure presented in the following written description and the various features and advantageous details thereof, are explained more fully with reference to the non-limiting examples included in the accompanying drawings and as detailed in the description, which follows. Descriptions of well-known components have been omitted so to not unnecessarily obscure the principal features described herein. The examples used in the following description are intended to facilitate an understanding of the ways in which the disclosure can be implemented and practiced. Accordingly, these examples should not be construed as limiting the scope of the claims.

Figure 1:
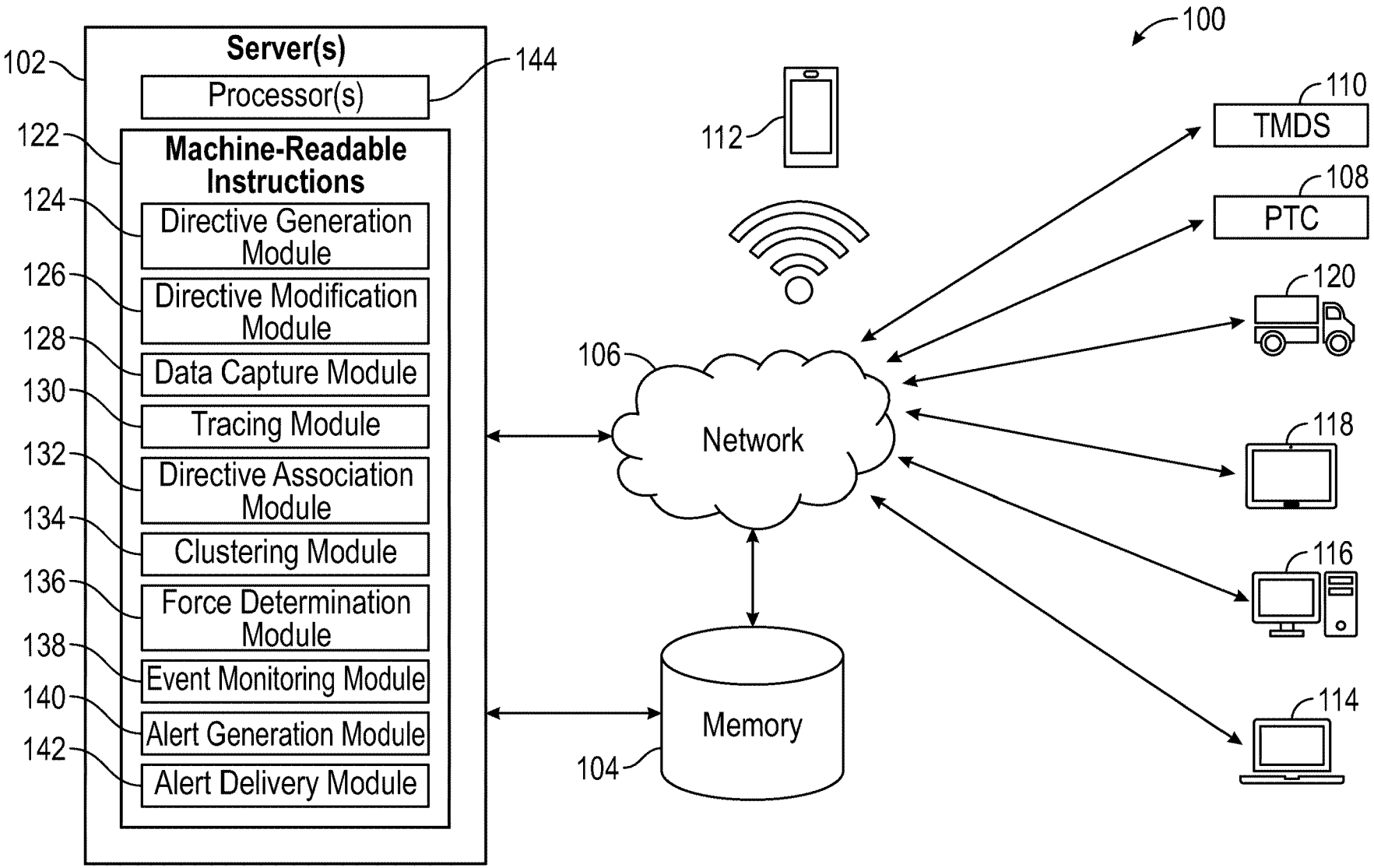
FIG. 1 illustrates a schematic view of a compaction tracking system, in accordance with one or more exemplary embodiments of the present disclosure.

FIG. 1 illustrates a schematic view of a compaction tracking system 100 in accordance with one or more embodiments of the present disclosure. The system 100 can include one or more servers 102 operably coupled to a database 104. The server 102 can be operably coupled to one or more clients 108, 110, 112, 114, 116, 118, 1120 via a network connection 106. The clients can be a physical device (e.g., mobile phone 112, computer 110, 116, tablet 118, vehicle 120, onboard computer, wearable device, worker, worker-related device, alert device, or other suitable device), program, or an application. In one example, a client can include a wearable device such as a watch, smart watch, totem, token, badge, or any other wearable device. In another embodiment, the server 102 can be operably coupled to a positive train control (PTC) system 108 via the network 106. For example, the PTC system 108 can be like those known in the art. In another example, the PTC system 108 can be a networked computer 108 in operable connection with the server 102 that is capable of receiving and/or obtaining vehicle and worker data and transmitting the data to the server 102. In another embodiment, the server 102 can be operably coupled to a train management and dispatch (TMDS) system 110 via the network 106. For example, the TMDS system 110 can be like those known in the art. In another example, the TMDS system 110 can be a networked computer 110 in operable connection with the server 102 that is capable of receiving and/or obtaining vehicle, track, maintenance, and/or worker data and/or transmitting the data to the server 102. In another embodiment, the server 102 can be in operable communication with a vehicle 120, such as a rail vehicle. For example, the system 100 can be configured such that the rail vehicle 120 can receive and/or transmit data to and/or from the server 102.

The system 100 can be integrated with a railroad system or railroad infrastructure to facilitate the generation, promulgation, modification, and/or termination of directives related to the railroad. It will be understood by those having skill in the art that detections, captured data, measurements, determinations, alerts, etc. encompassed by the system 100 can be promulgated and/or accessible to a railroad system at large via the network 106 or other operable connection. In one embodiment, the server 102 can include machine-readable instructions 122; in another embodiment, the server 102 can access machine readable instructions 122. In another embodiment, the machine-readable instructions can include instructions related to a directive generation module 124, a directive modification module 126, a data capture module 128, a tracing module 130, a directive association module 132, a clustering module 134, a force determination module 136, an event monitoring module 138, an alert generation module 140, and/or an alert delivery module 142.

The aforementioned system components (e.g., server(s) 102, PTC system 108, TMDS system 110, and client(s) 112, 114, 116, 118 etc.) can be communicably coupled to each other via the network 106, such that data can be transmitted. The network 106 can be the Internet, intranet, or other suitable network. The data transmission can be encrypted, unencrypted, over a VPN tunnel, or other suitable communication means. The network 106 can be a WAN, LAN, PAN, or other suitable network type. The network communication between the clients, server 102, or any other system component can be encrypted using PGP, Blowfish, Twofish, AES, 3DES, HTTPS, or other suitable encryption. The system 100 can be configured to provide communication via the various systems, components, and modules disclosed herein via an application programming interface (API), PCI, PCI-Express, ANSI-X12, Ethernet, Wi-Fi, Bluetooth, or other suitable communication protocol or medium. Additionally, third party systems and databases can be operably coupled to the system components via the network 106.

The data transmitted to and from the components of system 100 (e.g., the server 102, PTC system 108, TMDS system 110, and clients), can include any format, including JavaScript Object Notation (JSON), TCP/IP, XML, HTML, ASCII, SMS, CSV, representational state transfer (REST), or other suitable format. The data transmission can include a message, flag, header, header properties, metadata, and/or a body, or be encapsulated and packetized by any suitable format having same.

One or more server(s) 102 can be implemented in hardware, software, or a suitable combination of hardware and software therefor, and may comprise one or more software systems operating on one or more servers, having one or more processors 144, with access to memory 104. Server(s) 102 can include electronic storage, one or more processors, and/or other components. Server(s) 102 can include communication lines, connections, and/or ports to enable the exchange of information via a network 106 and/or other computing platforms. Server(s) 102 can also include a plurality of hardware, software, and/or firmware components operating together to provide the functionality attributed herein to server(s) 102. For example, server(s) 102 can be implemented by a cloud of computing platforms operating together as server(s) 102, including Software-as-a-Service (SaaS) and Platform-as-a-Service (PaaS) functionality. Additionally, the server(s) 102 can include memory 104 internally.

Memory 104 can comprise electronic storage that can include non-transitory storage media that electronically stores information. The electronic storage media of electronic storage can include one or both of system storage that can be provided integrally (e.g., substantially non-removable) with server(s) 102 and/or removable storage that can be removably connectable to server(s) 102 via, for example, a port (e.g., a USB port, a firewire port, etc.) or a drive (e.g., a disk drive, etc.). Electronic storage may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage may include one or more virtual storage resources (e.g., cloud storage, a virtual private network, and/or other virtual storage resources). The electronic storage can include a database, or public or private distributed ledger (e.g., blockchain). Electronic storage can store machine-readable instructions 122, software algorithms, control logic, data generated by processor(s), data received from server(s), data received from computing platform(s), and/or other data that can enable server(s) to function as described herein. The electronic storage can also include third-party databases accessible via the network 106.

Processor(s) 144 can be configured to provide data processing capabilities in server(s) 102. As such, processor(s) 144 can include one or more of a digital processor, an analog processor, a digital circuit designed to process information, an analog circuit designed to process information, a state machine, and/or other mechanisms for electronically processing information, such as FPGAs or ASICs. The processor(s) 144 can be a single entity or include a plurality of processing units. These processing units can be physically located within the same device, or processor(s) 144 can represent processing functionality of a plurality of devices or software functionality operating alone, or in concert.

The processor(s) 144 can be configured to execute machine-readable instructions 122 or machine learning modules via software, hardware, firmware, some combination of software, hardware, and/or firmware, and/or other mechanisms for configuring processing capabilities on processor(s) 144. As used herein, the term "machine-readable instructions" can refer to any component or set of components that perform the functionality attributed to the machine-readable instructions component 122. This can include one or more physical processors 144 during execution of processor-readable instructions, the processor-readable instructions, circuitry, hardware, storage media, or any other components.

The server(s) 102 can be configured with machine-readable instructions 122 having one or more functional modules. The machine-readable instructions 122 can be implemented on one or more servers 102, having one or more processors 144, with access to memory 104. The machine-readable instructions 122 can be a single networked node, or a machine cluster, which can include a distributed architecture of a plurality of networked nodes. The machine-readable instructions 122 can include control logic for implementing various functionality, as described in more detail below. The machine-readable instructions 122 can include certain functionality associated with the system 100. Additionally, the machine-readable instructions 122 can include a smart contract or multi-signature contract that can process, read, and write data to a database, distributed ledger, or blockchain.

Figure 2:
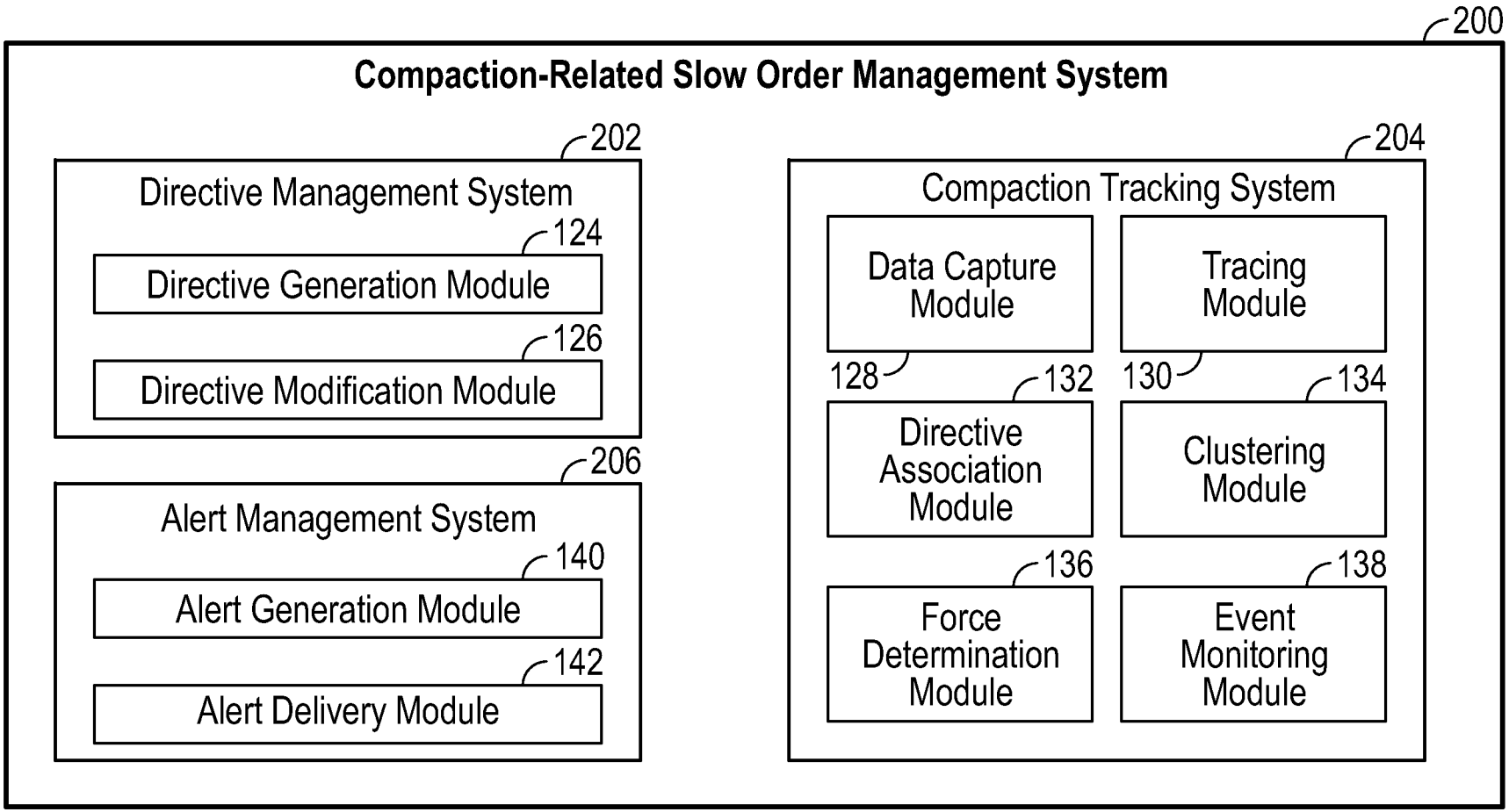
FIG. 2 illustrates an exemplary block diagram of a compaction-related slow order management system, in accordance with one or more exemplary embodiments of the present disclosure.

FIG. 2 illustrates a schematic view of a compaction-related slow order management system 200. In one embodiment, the system 200 can include a directive management system 202, a compaction tracking system 204, and/or an alert management system 206. In one embodiment, the directive management system 202 can be configured to generate, promulgate, and/or modify directives in a railroad system, such as slow orders in a railroad system. In another embodiment, the compaction tracking system 204 can be configured to monitor forces applied across a railroad track infrastructure to track the compaction under the track. In another embodiment, the alert management system 206 can be configured to generate and deliver alerts across a railroad infrastructure, such as alerts related to directives and/or tracked compaction. In one exemplary embodiment, the directive management system 202 can include a directive generation module 124 and a directive modification module 126. In another embodiment, the compaction tracking system 204 can include a data capture module 128, a tracing module 130, a directive association module 132, a clustering module 134, a force determination module 136, and an event monitoring module 138. In another embodiment, the alert management system 206 can include an alert generation module 140 and an alert delivery module 142.

In one embodiment, the directive generation module 124 can generate directives to instruct railroad personnel of particular instructions related to railroad infrastructure. For example, the directive generation module 124 can receive input from railroad personnel indicating that a particular area has undergone maintenance. In one embodiment, the directive generation module 124 can generate a slow order for a particular section of track that has recently received maintenance based on such input. Another example, the directive generation module 124 can receive an indication from the railroad infrastructure that maintenance has been performed. In another example, the director generation module 124 can receive any other data related to a railroad infrastructure and utilize such data to determine whether a directive should be generated. For example, the directive generation module 124 can receive an indication that a particular type of work was performed on a section of track and determine that such work could require a slow order. In another embodiment, the directive generation module 124 can be configured in any manner to facilitate the generation of directives related to a railroad infrastructure.

In one embodiment, the directive modification module 126 can modify directives, such as directives generated by the directive generation module 124. For example, the directive modification module 126 can receive data or indications (such as from the compaction tracking system 204 and/or alert management system 206) and utilize such received data and or indications to determine whether a directive should be modified. For example, the directive modification module 126 can receive compaction tracking data and determine if such data meets a compaction threshold such that a slow order should be lifted from a particular section of track. In another embodiment, the directive modification module 126 can determine that a slow order should be modified, such as to increase and/or decrease the maximum allowed speed communicated by the slow order. In another embodiment, the directive modification module 126 can modify any other directive related to railroad infrastructure, including stop orders or any other directives.

For example. the directive modification module 126 can receive data and/or indications from one or both of the compaction tracking system 204 and/or alert management system 206 and utilize such data/information to determine appropriate modifications and/or generate/perform such modifications to existing directives. Modification can include changing allowed speeds, lengths of slow orders, tonnage requirements, and/or any other modifications to one or more directives. In one example, the directive modification module 126 can utilize one or more specialized algorithms to consider environmental thresholds, force thresholds, event thresholds, or any other predetermine thresholds in determine directive modifications. For example, the following table can illustrate how the directive modification module 126 can determine and/or modify directives based at least in part on one or more thresholds, such as environmental and/or force thresholds:

| Max. Rail Temp. Reached or Predicted for Duration to Operate 20 Qualifying Trains, 0.1 MGT or 5 Days [1] | Minimum Duration and Maximum Speed for Consolidation Temporary Speed Restrication (TSR) After Work Is Completed Using Train Count |
|---|---|
| TNT +20° F. and over | 2 trains at 15 MPH, if track is OK after each train, then 4 trains at 15 MPH. If track is OK, then 4 trains at 30 MPH, then 10 trains at 45 MPH, then maximum authorized speed.<br>If the rail temperature falls below TNT +20° F. white operating the additional 4 trains at 15 MPH, operate the balance of the 4 trains at 30 MPH. |
| Between TNT +5° F. and TNT +19° F. | 1 train at 15 MPH. If track is OK, then 9 trains at 30 MPH, then 10 trains at 45 MPH, then maximum authorized speed.<br>If the rail temperature at the time the second train will traverse the limits of the restriction is TNT +5° F. and over, then run one additional train at 15 MPH and inspect afterwards. |
| Between TNT +5° F. and TNT −20° F. | 5 trains at 30 MPH, then 5 trains at 45 MPH, then maximum authorized speed. |
| TNT −20° F. and under | 2 trains at 30 MPH, then maximum authorized speed. |

In another embodiment, the above table can contain the minimum requirements for temporary speed restrictions (e.g., directives) and can be primary focused on work activities that can disturb the ballast sections. In another example, if conditions warrant, a more restrictive speed and/or duration can be directed. In another embodiment, during a time of day in which sunlight is not a factor in elevating rail temperatures, certain rules and/or exception can be utilized by the directive modification module 126. For example, if a compaction speed restriction (e.g., slow order and/or directive) is in effect and the rail temperature remains above a temperature threshold, the directive modification module 126 can determine that the requirements of the above table should be adhered to. In another example, if the temperature drops below the threshold temperature, any compaction slow order for work done without a track stabilizer first having addressed the area that has previously been raised to thirty mph in accordance with the above table may be raised or removed between particular hours, such as between 2200 and 0900 hours. In another example, a speed restriction may remain modified or removed if the required tonnage or number of trains as can be specified in the above table have passed over the affected segment of track during the period of time the rail temperature dropped below a temperature threshold. In another embodiment, at a particular point in time (e.g., 0900 hours), or if the rail temperature rises to or above a temperature threshold, and the original force threshold or event threshold originally required for compaction in the above table have not been reached, the directive modification module 126 can reestablish the speed restriction. In another example, the directive modification module 126 can decide that the restriction can remain in place until the a max force measurement satisfies a force threshold, and/or until a number of events meeting particular event criteria have satisfied one or more event thresholds, or until a qualified employee has inspected the affected segment of track.

In one exemplary embodiment, the data capture module 128 can be configured to receive and/or capture data from a myriad of sources that can be related to a railroad track, railroad vehicles, and/or a railroad infrastructure. For example, the data capture module 128 can be configured to receive directive data, track data, segment identification data, vehicle detection data, speed data, force data, weight data, rail data, rail temperature, or any other data related to a railroad infrastructure. For example, the data capture module 128 can be an operable communication with one or more databases (such as database 104) that can store such data. In another embodiment, the data capture module 128 can be configured to capture data related to, for example, a railroad track. For example, the data capture module 128 can utilize sensors, cameras, thermometers, radar, LIDAR, or any other component or mechanism suitable to capture and/or collect data related to railroad infrastructure. In another embodiment, the data capture module 128 can be configured to receive input from personnel, systems, or any other entity related to railroad infrastructure data. In another embodiment, the data capture module 128 can be configured to receive information related to a load and/or a freight carried by one or more rail vehicles. In another embodiment, the data capture module 128 can be configured to capture positional data points of a vehicle on a track.

For example, the data capture module 128 can be coupled with sensors operable to measure a weight and/or force applied to one or more sections of a railroad track. In another example, the data capture module 128 can be coupled with sensors operable to identify a train on a railroad track. In another example, the data capture module 128 can be configured to receive data from another portion of the compaction-related slow order management system 200 or other system that can include data related to a train and/or load of the train. In another embodiment, the data capture module 128 can be configured to utilize sensors or available connections to receive and/or capture data related to track maintenance and/or ballast disturbance. In one example, the data capture module 128 can be configured to receive data related to a current, such as an electrical current, that can be active in a railroad track. For example, the data capture module 128 can be configured to utilize sensors or other components to measure resistance, voltage, or any other indications regarding a current in the track. In another example, the data capture module 128 can be configured to capture data related to rail temperature. In another example, the data capture module 128 can be configured to capture data related to environmental conditions, including climate, temperature, humidity, wind speed, and/or any other environmental data related to a railroad.

In another exemplary embodiment, the tracing module 130 can be configured to receive data from the data capture module 128 and utilize such data to trace a path of a rail vehicle along one or more segments of a railroad track. For example, the tracing module 130 can be configured to communicate with the data capture module 128 such that the tracing module can track which segments of track a vehicle was detected on. In one embodiment, the data capture module 128 can be configured to detect aberrations in a current of the track caused by a vehicle traveling on the track, and the tracing module 130 can be configured to trace a path vehicle using such data. In another embodiment, the tracing module 130 can be configured to communicate with one or more systems, such as to receive information related to an identification of a vehicle traveling on a track, such that the tracing module 130 can associate a vehicle identity with a vehicle traveling at a certain location. In another embodiment, the tracing module 130 can identify individual track segments and associate data received from the data capture module 128 with such track segments, such as to determine which track segments a vehicle has passed over.

In another embodiment, the tracing module 130 can be configured to utilize positional data points related to at least two track segments to determine a path of a vehicle over at least a third track segment. For example, the data capture module 128 can capture positional data points related to a vehicle's movement over a track, and the tracing module 130 can be configured to trace a path between such two data points to determine whether the vehicle traveled over a third segment, such as could be between the two data points, and such as if a positional data point related to the third track segments was not captured by the data capture module 128. In another example, the tracing module 130 can be configured to map a path of a vehicle along a track using such positional data points.

In one exemplary embodiment, the directive association module 132 can be configured to receive directive data, such as data related to directives generated and/or modified by the directive management system 202, and can further associate such directive data with one or more segments of a railroad track. For example, a directive can be a slow order that can instruct railroad vehicles to not exceed a particular speed for particular length of track that can include one or more track segments. In another example, the directive association module 132 can receive this directive data and associate it with track segments that can be included enter the length of rail covered by the directive, such that the directive association module 132 can identify each track segment related to the directive. In another embodiment, the directive association module 132 can be configured to generate and/or recognize any other suitable relationship between a directive generated and/or modified by the directive management system 202 add a railroad track and/or track segments.

In another exemplary embodiment, the clustering module 134 can be configured to generate data clusters related to individual track segments. For example, the clustering module 134 can be configured to receive data from the data capture module 128 and/or the tracing module 130 and cluster such received data with respect to individual track segments. For example, the clustering module 134 can determine that events have occurred on a particular track segment and determine whether such events and/or data related to such events should be aggregated. In another example, the clustering module 134 can determine and/or receive that a vehicle has traveled over a particular track segment and include such event with a cluster of other similar events. In another example, a clustering module 134 can determine and/or receive data related to vehicle identity and/or load and aggregate such data in a data cluster related to the track segment. In another example, the clustering module 134 can count and/or determine any other types of events associated with particular track segments, such as maintenance, work orders, rail condition, or any other events suitable to be associated with a particular track segment.

In another exemplary embodiment, force determination module 136 can be configured to determine one or more force is applied to a particular track segment or railroad track. In one embodiment, force determination module 136 can receive data from the data capture module 128, the tracing module 130, the directive association module 132, and/or the clustering module 134 and utilize such data to determine a force or forces applied to a track and/or track segment. In one example, the forced determination module 136 can receive data related to a load of a train and utilize such data to determine a force that the train applies to a particular segment of a track. In another example, the force determination module 136 can receive a load weight or force determination from another part of the system 200. And another example, the force determination module can utilize data clusters generated by the clustering module 134 to calculate total force applied to a particular track segment. For example, the clustering module 134 can generate data clusters with each data point usable by the force determination module 136 to determine a force applied to such track segment as related to such data point. In another example, force determination module 136 can calculate a force associated with each data point of a data cluster generated by the clustering module 134 to determine a total force applied to a particular track segment. In another embodiment, the force determination module 136 can be configured to calculate, sense, or otherwise determine a force or forces applied to a track or track segment in any other suitable manner.

In another embodiment, the forced determination module 136 can be configured to compare forces with one or more force thresholds. For example, the force determination module 136 can determine that for a particular directive to be modified and/or terminated, a total force calculated over at least one segment of a track that is associated with the directive must exceed a particular force threshold. In another embodiment, the force determination module can compare individual events and/or forces with one or more force thresholds to determine whether the applied force satisfies the one or more force thresholds. In another embodiment, the force determination module 136 can implement and/or utilize any number of force thresholds in determining applied force, total force, or any other force measurements and/or comparisons suitable to facilitate compaction tracking by the compaction tracking system 204.

In another exemplary embodiment, the event monitoring module 138 can be configured to compare events with particular criteria and determine whether such events should be included in an event total for a track or track segments. In one embodiment, the event monitoring module 138 can be configured to receive data from the data capture module 128, the tracing module 130, the directive association module 132, the clustering module 134, and/or the force determination module 136 to facilitate the determination of event criteria and/or comparison of such data with particular event criteria and/or thresholds. In another embodiment, the event monitoring module 138 can include one or more event thresholds and can compare data to such thresholds to determine whether such events should be included in an event count. For example, the event monitoring module can receive and/or determine the force applied by a vehicle to a track and compare such force with an event threshold, and if the force satisfies the event threshold, the event monitoring module 138 can increment an event counter for such event. In another embodiment, the event monitoring module 138 can receive data related to the speed of a vehicle traveling over a track or track segment and compare such speed with a speed threshold, and if such speed threshold is satisfied, the event monitoring module 138 can increment an event count related to such event. In another embodiment, the event monitoring module 138 can implement any number of event criteria, including vehicle type, rail type, rail temperature, ambient temperature, time of day, force, speed, and/or any other criteria and/or thresholds related to such criteria to monitor and/or count events of particular categories.

In another exemplary embodiment, the alert generation module 140 can be configured to receive data from the directive management system 202 and/or the compaction tracking system 204 and utilize such data to determine whether an alert should be generated. For example, the alert generation module 140 can receive directive data from the directive management system 202 and determine if such directive requires an alert to be generated. In another embodiment, the alert generation module 140 can receive directive modification data from the directive management system 202 and determine if such directive modification requires alert generation. In another embodiment, the alert generation module 140 can receive data from the compaction tracking system 204, such as data indicating whether a force threshold has been satisfied and/or whether an event threshold has been satisfied, and further determine whether an alert should be generated if one or both of such thresholds has been satisfied. In another embodiment, the alert generation module 140 can receive data and/or indications from one or more systems to determine whether an alert should be generated. For example, the alert generation module can receive input from personnel, the PTC system, the TMDS system, or any other system in operable communication with the alert management system 206, and/or the directive management system 202 and/or the compaction tracking system 204.

In another exemplary embodiment, the alert delivery module 142 can be configured to receive alerts generated by the alert generation module 140 and deliver such alerts throughout a railroad infrastructure. For example, the alert delivery module 142 can deliver alerts to the PTC system, the TMDS system, and/or any other system in operable communication with the alert management system 206 and/or the directive management system 202 and/or the compaction tracking system 204. In another embodiment, the alert delivery module 142 can be configured to prioritize methods of delivery based on available connection types. In another embodiment, the alert delivery module 142 can be configured to deliver alerts to the directive management system 202 and in one embodiment, the directive management system 202 can utilize such alerts to determine whether to modify a directive. In another embodiment, the alert delivery module 142 can deliver an alert to the compaction tracking system 204, such as to indicate that a directive has been generated and/or modified, such as by the directive management system 202. In another embodiment, the alert delivery module 142 can be configured to deliver and/or transmit any other alerts related to a railroad throughout a railroad system.

Figure 3A:
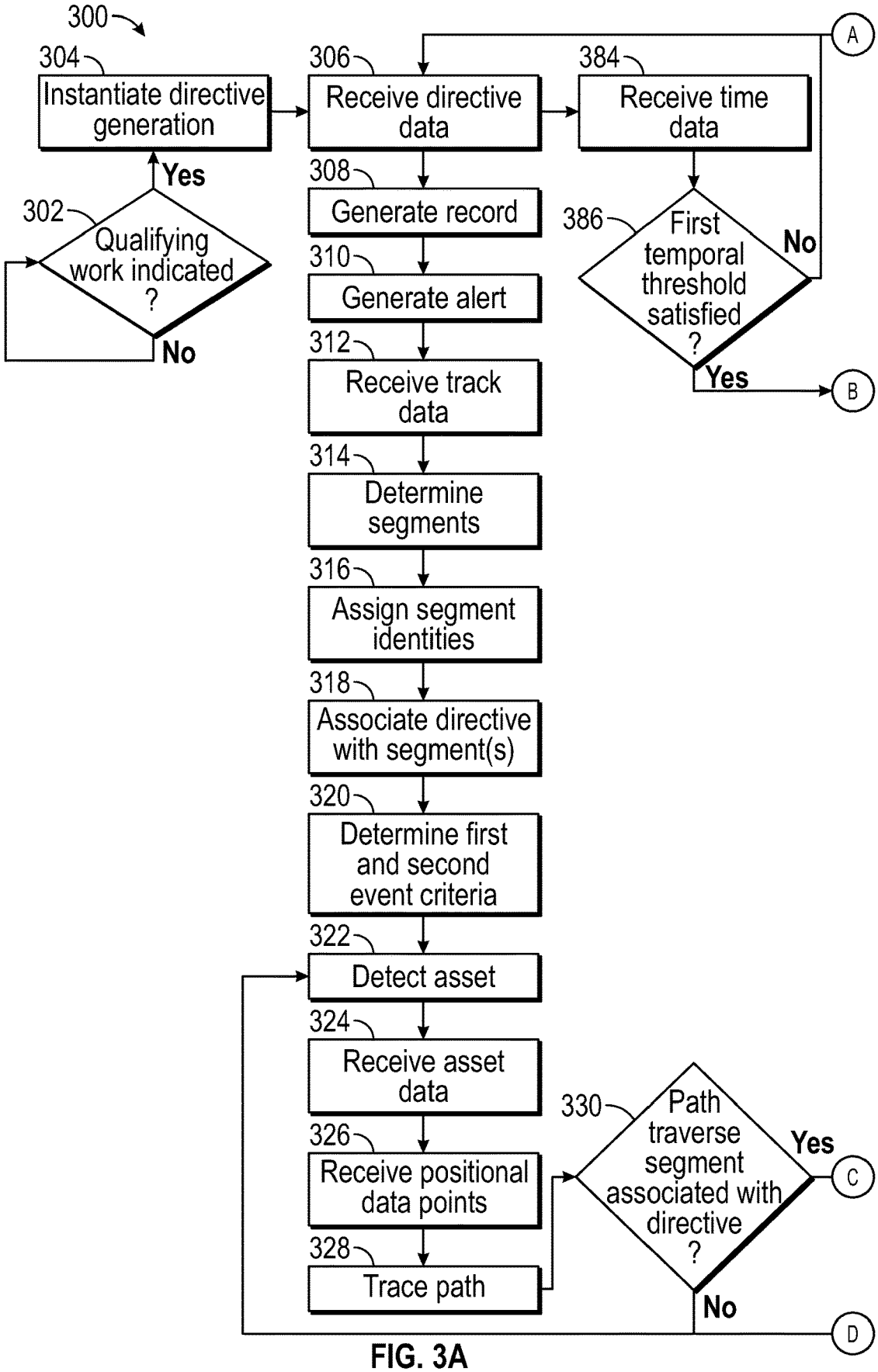
FIG. 3A illustrates a flowchart exemplifying a directive governance system, in accordance with one or more exemplary embodiments of the present disclosure.
Figure 3B:
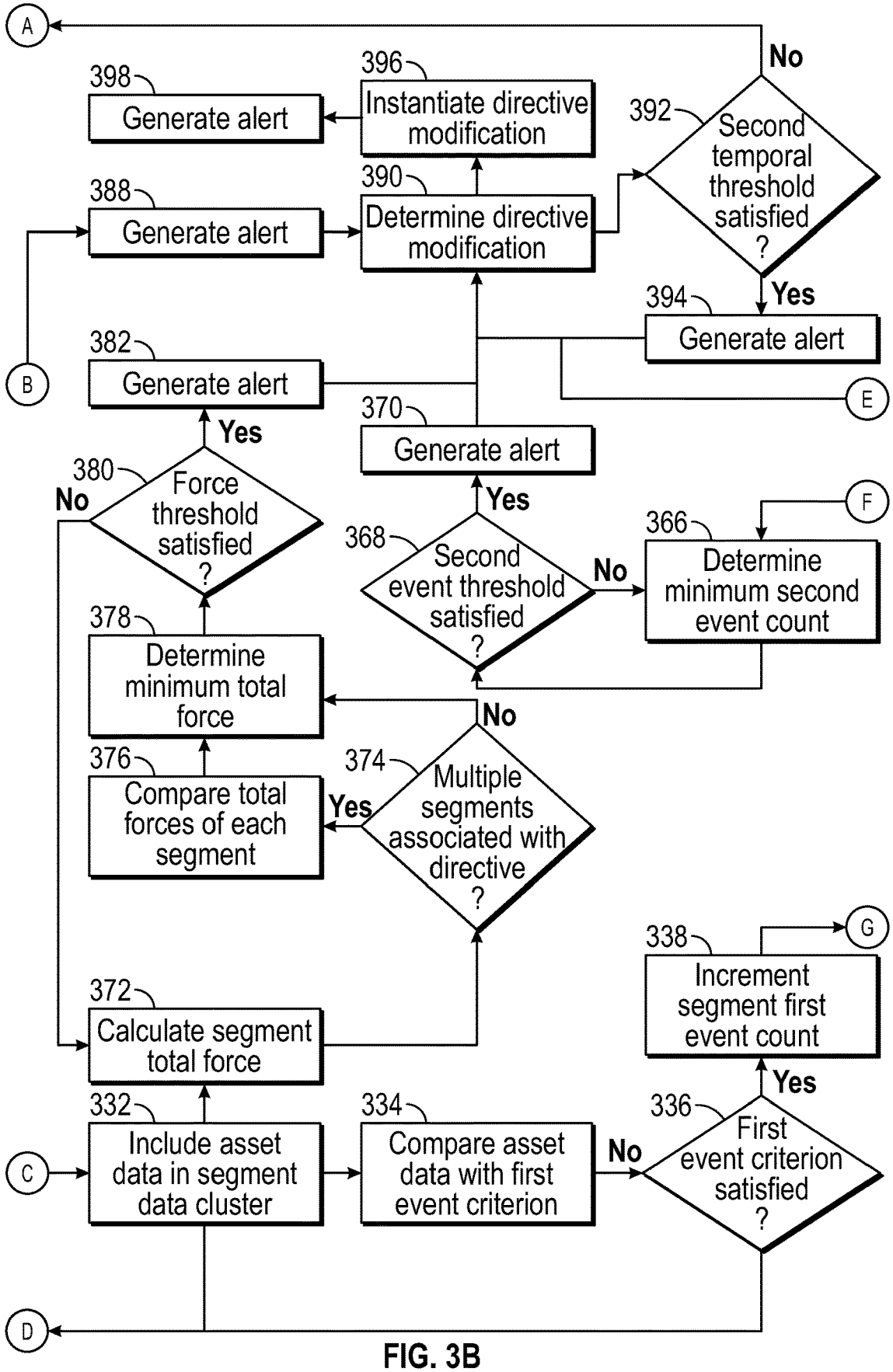
FIG. 3B illustrates a flowchart exemplifying a directive governance system, in accordance with one or more exemplary embodiments of the present disclosure.
Figure 3C:
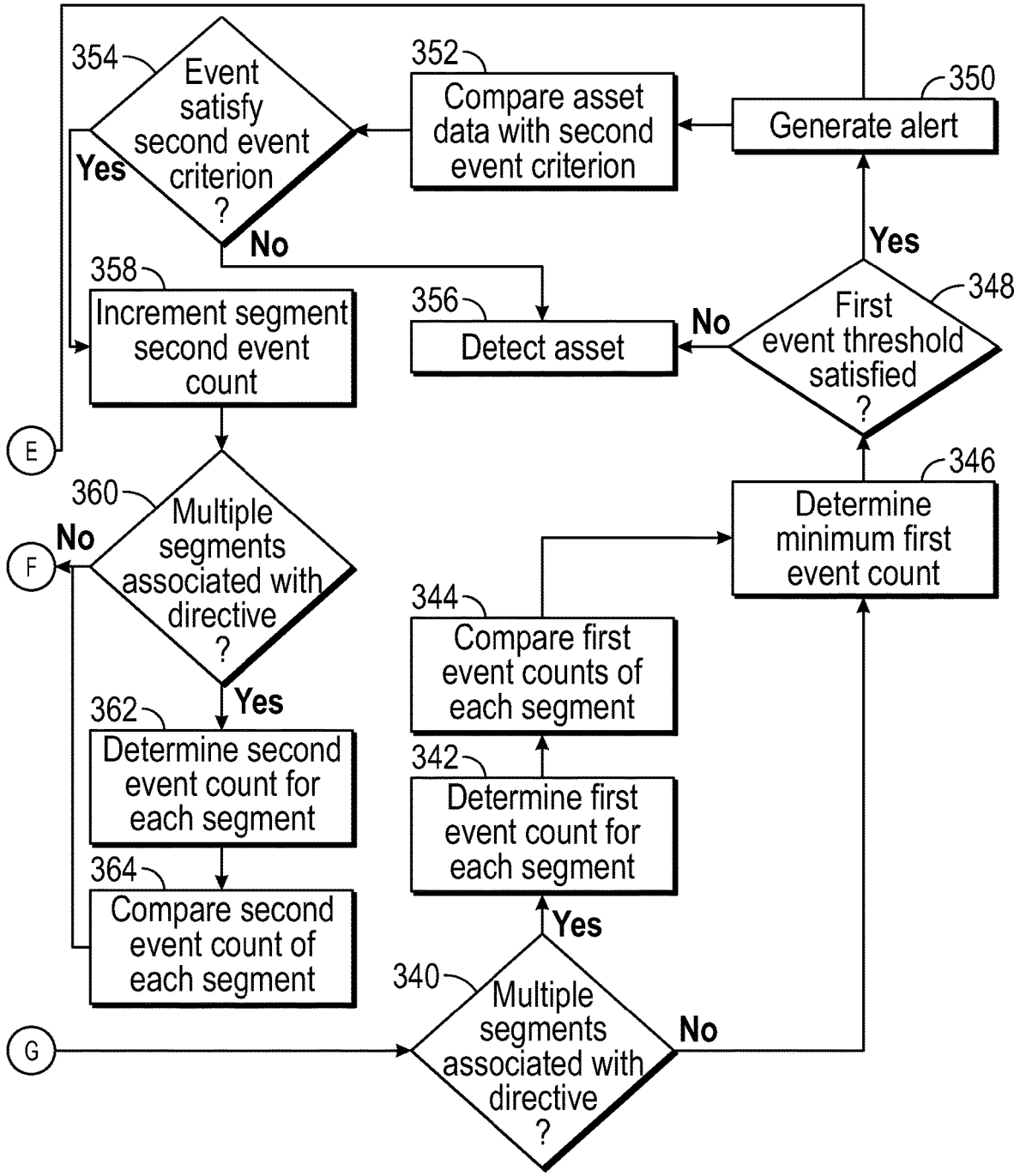
FIG. 3C illustrates a flowchart exemplifying a directive governance system, in accordance with one or more exemplary embodiments of the present disclosure.

FIGS. 3A-3C illustrate a flow chart diagram 300 exemplifying control logic embodying features of a directive governance system 300, in accordance with an exemplary embodiment of the present disclosure. The directive governance control logic 300 can be implemented as an algorithm on a server (e.g., server 102), a machine learning module, or other suitable system. Additionally, the directive governance control logic 300 can implement or incorporate one or more features of the compaction-related slow order management system 200, including the directive management system 202, the compaction tracking system 204, and the alert management system 206. The directive governance control logic 300 can be achieved with software, hardware, an application programming interface (API), a network connection, a network transfer protocol, HTML, DHTML, JavaScript, Dojo, Ruby, Rails, other suitable applications, or a suitable combination thereof.

The directive governance control logic 300 can leverage the ability of a computer platform to spawn multiple processes and threads by processing data simultaneously. The speed and efficiency of the directive governance control logic 300 is greatly improved by instantiating more than one process to facilitate personnel safety. However, one skilled in the art of programming will appreciate that use of a single processing thread may also be utilized and is within the scope of the present disclosure.

The directive governance control logic 300 process flow of the present embodiment begins at step 302, wherein the control logic 300 determines whether it receives an indication of qualifying work. For example, the control logic 300 can receive an indication that a particular portion and/or segment of track has been worked on, and if such work is of the type that can disturb the ballast, the control logic 300 can determine that the work his qualifying work. In another embodiment, the control logic 300 can receive an input or other indication from another system and/or personnel that such qualifying work has been performed. If the control logic 300 does not receive such indication, the control logic 300 will await the reception of such indication. If the control logic 300 receives such indication, the control logic 300 then proceeds to step 304.

At step 304, the control logic 300 can instantiate directive generation. For example, the control logic 300 can instantiate a directive generation process, such that a directive related to the qualifying work can be generated. For example, the control logic 300 can indicate to personnel that a directive should be generated because qualifying work has been performed. In another embodiment, the control logic 300 can itself generate a directive related to a particular portion of track and transmit such directive. In another embodiment, the control logic 300 can request a directive. In another embodiment, the control logic 300 can instantiate any suitable process by which a directive can be generated. The control logic 300 then proceeds to step 306.

At step 306, the control logic 300 can receive directive data. For example, the control logic 300 can receive the type of directive, the instructions of the directive, the portion of track with which the directive is associated, track segments with which the directive data is associated with, or any other data related to the directive. For example, the control logic 300 can receive that the directive is a slow order that can instruct vehicles to reduce speed on a particular portion of railroad track. In another embodiment, the control logic 300 can receive data related to how the directive can be modified and/or terminated. For example, the control logic 300 can receive data or related to a force threshold needed to be satisfied to modify the directive. In another example, the control logic 300 can receive an event count threshold and/or event threshold that must be satisfied for the directive to be modified and/or lifted. The control logic 300 then proceeds to step 308 and to step 384.

At step 308, the control logic 300 can generate a record. For example, the record can include the directive, and/or data related to the directive. In one embodiment, the record can include a time and date of the directive, instructions of the directive, and/or any other data related to the directive. In another embodiment, the record generated at step 308 can be configured to store additional data generated and/or modified by the control logic 300. In this manner, the record generated at step 308 can include the directive and associated data as well as events and or vehicles and or any other data related to the directive and/or modification thereof. The control logic 300 then proceeds to step 310.

At step 310, the control logic 300 can generate an alert. For example, the control logic 300 can determine that because directive data was received, and alert should be generated. In another embodiment, the control logic 300 can transmit the alert among the railroad system and/order to railroad personnel. For example, the control logic 300 can notify one or more systems as well as associated personnel that a directive has been instantiated with respect to a particular portion of railroad track. The control logic 300 then proceeds to step 312.

At step 312, the control logic 300 can receive track data. For example, the control logic 300 can receive track location data, track segment data, track segment identification data, track type, track condition, or any other data related to the track. The control logic 300 then proceeds to step 314.

At step 314, the control logic 300 can determine segments. For example, the control logic 300 can receive data related to a particular length of track at step 312 and determine how such length of track is to be segmented at step 314. For example, the control logic 300 can receive as indications in the track data how the length of track should be segmented. In another embodiment, the control logic 300 can decide based on track data how the track should be segmented. For example, the control logic 300 can determine that a mainline and a siding are both present and further determine that a piece of the main line should be a different segment from the siding. In another embodiment, the control logic 300 can determine that a segment should be a particular length, such that a portion of track can be split up into segments by segment length. I another embodiment, the control logic 300 can determine segments by any suitable mechanism, including the presence of particular equipment, tie composition, rail type, age, or any other criteria suitable to enable the control logic 300 to segment a portion of railroad track into one or more segments. In another embodiment, the control logic 300 can determine track segments in any manner suitable to enable directive governance. The control logic 300 then proceeds to have 316.

At step 316, the control logic 300 can assign segment identities. For example, the control logic can assign identifiers to the segments determined at step 314. In another embodiment, the control logic 300 can receive indications from the track data of how each segment should be identified. In another embodiment, the control logic 300 can assign identification numbers to each segment. In another embodiment, the control logic 300 can identify and/or assigned segment identities and any manner suitable to allow the control logic 300 to distinguish between one or more track segments. The control logic 300 then proceeds to step 318.

At step 318, the control logic 300 can associate a directive with one or more track segments. For example, the control logic can utilize the directive data received in step 306 to determine with which length of track the directive should be associated with. The control logic 300 can then utilize track data received at step 312, segments determined at step 314, and segment identities determined in step 316 to determine with which segments the directive should be associated with. For example, the control logic 300 can determine which segments are covered by the directive. The control logic 300 then proceeds to step 320.

At step 320, the control logic 300 can determine first and second event criteria. For example, the control logic 300 can determine different types of events to count. For example, the control logic 300 can receive indications from other systems and/or personnel as to which events should be counted. In another example, the control logic 300 can include criteria related to first and second event types. In another embodiment, the control logic 300 can determine that a first type of event should be counted and that a second type of event should also be counted. For example, the control logic 300 can determine that the first event criteria include vehicles traveling at a particular velocity. In another example, the control logic 300 can determine that the second event criteria include vehicles traveling with a particular load. In another embodiment, the control logic 300 can determine that either the first or second event criteria include a vehicle traveling at a particular speed and having a particular load. In another embodiment, the control logic 300 can utilize any other criteria relevant to the directive and/or modification thereof. In another embodiment, the control logic 300 can utilize any event criteria suitable to enable the control logic 300 to track compaction of the ballast and/or determine whether a directive should be modified and/or terminated. The control logic 300 then proceeds to step 322.

At step 322, the control logic 300 can detect an asset. For example, the control logic 300 can detect a vehicle on a track. In another example, the control logic 300 can be in operable communication with one or more sensors, systems, or any other components suitable to detect a vehicle and/or other asset. The control logic 300 then proceeds to step 324.

At step 324, the control logic 300 can receive asset data. For example, the control logic 300 can receive data related to identification of the asset, a load the asset is carrying, a speed the asset is traveling, or any other data related to the asset. In another embodiment, the control logic 300 can be in operable communication with any number of sensors or other data collectors to capture and/or receive data related to the asset. The control logic 300 then proceeds to step 326.

At step 326, the control logic 300 can receive positional data points. For example, the control logic 300 can receive data points related to the position of detection of the asset. For example, the control logic 300 can be in communication with one or more sensors configured to read an electrical current in the track, and the control logic 300 can utilize such sensors to detect position of an asset on the track. In another embodiment, the control logic can utilize a Global Positioning System, radar, low energy Bluetooth, or any other type of communication and/or protocol and/or data to determine positions of assets on railroad tracks. In another embodiment, the control logic 300 can receive positional data points that can be associated with particular track segments determined and/or identified in steps 314 and 316. For example, the control logic 300 can receive positional data points at step 326 that indicate and asset's position on a particular track segment. The control logic 300 then proceeds to step 328.

At step 328, the control logic 300 can trace a path. For example, the control logic can utilize the positional data points received in step 326 to trace a path along a railroad track. For example, the control logic 300 can receive positional data points and/or recognize that an asset is and/or was present on a particular track segment, and further trace a path along the track using the identified track segments. For example, the control logic 300 can receive positional data points indicating that an asset is and/or was located on two separate track segments. The control logic 300 can then trace a path between such two track segments and determine if the path traverses a third track segment. In this manner, the control logic 300 can determine a path of and asset along one or more track segments of a railroad track. In another embodiment, in this manner, the control logic 300 can determine events and/or forces applied to one or more track segments even if the control logic 300 did not receive positional data points at step 326 that directly indicated that an asset traveled along a particular track segment. The control logic 300 then proceeds to step 330.

At step 330, the control logic 300 can determine whether a path traced at step 328 traversed a segment associated with the directive. For example, the control logic can compare a path traced in step 328 with the segments associated with the directive at step 318 and determine whether any of the segments traversed by the path are/were associated with the directive. The control logic 300 proceeds to step 322 if the control logic 300 determines that the path traced at step 328 does not traverse one or more segments associated with the directive. The control logic 300 then proceeds to step 332 if the control logic 300 determines that the path traced at step 328 traverses one or more segments associated with the directive.

At step 332, the control logic 300 can include asset data in a segment data cluster. For example, the control logic 300 can determine which segments associated with the directive were traversed by the path. In another embodiment, the control logic 300 can generate a data cluster associated with each track segment that can be associated with the directive and include asset data in such data clusters if the asset travels along a particular segment. The control logic 300 then proceeds to step 334 and 372.

At step 334, the control logic 300 can compare the asset data with first event criterion. For example, the control logic 300 can utilize the asset data received at step 324 and compare such data with first event criteria determined in step 320. In one embodiment, multiple criteria can be associated with the first event. In another embodiment, a single criterion can be associated with the first event. The control logic then proceeds to step 336.

At step 336, the control logic 300 can determine whether the asset data satisfies the first event criterion. For example, the control logic 300 can determine whether the asset satisfied a particular speed that can be required by the first event criterion. If the asset data does not satisfy the first event criterion, the control logic 300 then proceeds back to step 322. If the asset data satisfies the first event criterion, the control logic then proceeds to step 338.

At step 338, the control logic 300 can increment a segment first event count. For example, the control logic 300 can keep track of qualifying events for each segment associated with the directive. For example, the control logic 300 can associate one or more event counts with any particular segment and count the number of events satisfying particular event criteria. The control logic 300 then proceeds to step 340.

At step 340, the control logic 300 can determine whether multiple segments are associated with a particular directive. If the control logic 300 determines that multiple segments are associated with the directive, the control logic 300 then proceeds to step 342. If the control logic 300 determines that multiple segments are not associated with the directive, the control logic 300 then proceeds to step 346.

At step 342, the control logic 300 can determine a first event count for each segment associated with the directive. For example, the control logic 300 can keep track of first event counts for each segment associated with the directive such that the control logic 300 can compare first event counts for each segment associated with the directive. The control logic 300 the proceeds to step 344.

At step 344, the control logic 300 can compare first event counts of each segment. For example, the control logic can determine how many events satisfying the first event criteria have occurred for each segment. In this manner, the control logic 300 can ensure that before a directive is modified, each segment associated with the directive satisfies a particular criteria such that the directive is not lifted and/or modified prematurely. The control logic 300 then proceeds to step 346.

At step 346, the control logic 300 can determine a minimum first event count. For example, the control logic can utilize the comparison made at step 344 to determine which event count of which segment is the lowest. The control logic 300 then proceeds to step 348.

At step 348, the control logic can determine whether a first event threshold is satisfied. For example, the control logic 300 can utilize the minimum first event count determined in step 346 and compare such minimum event count with the first event threshold to determine whether the first event threshold is satisfied. In this manner, the control logic 300 can ensure that every segment associated with particular directive either meets or exceeds the first event threshold such that a directive is not lifted and/or modified prematurely. If the control logic 300 determines that the first event threshold is satisfied, the control logic 300 then proceeds to step 350. If the control logic 300 determines that the first event threshold is not satisfied, the control logic then proceeds to step 356.

At step 350, the control logic 300 can generate an alert. For example, the control logic could generate an alert indicating that the first event threshold has been satisfied and/or exceeded by every track segment associated with a particular directive. The control logic 300 then proceeds to step 352.

At step 352, the control logic 300 can compare the asset data with the second event criterion. For example, the second event criterion can be different from the first event criterion. In another embodiment, the control logic 300 can begin counting events satisfying the second event criterion after the first event threshold has been satisfied. The control logic 300 then proceeds to step 354.

At step 354, the control logic 300 can determine whether an event satisfies the second event criterion. For example, the control logic 300 can review the asset data and utilized the comparison made it step 352 to determine whether the asset data satisfies the second event criterion. For example, the second event criterion can be similar to the first event criterion. For example, the second event criterion can be related to a velocity of a vehicle. In another embodiment, the second event criterion could be related to a weight of a vehicle. Another embodiment, the second event criterion can be any other criterion relevant to tracking compaction and railroad infrastructure. If the control logic 300 determines that the asset data does not satisfy the second event criterion, the control logic then proceeds to step 356. If the control logic 300 determines that the asset data satisfies the second event criterion, the control logic 300 then proceeds to step 358.

At step 356, the control logic 300 can detect an asset. For example, the control logic 300 can detect an asset similar to step 322. For example, the control logic 300 can await detection of an asset such that the control logic can begin the process beginning at step 324 again.

At step 358, the control logic 300 can increment a segment second event count. For example, the segment second event count can be similar to the segment first event count except that it corresponds to second event types occurring on the segment as opposed to first event types occurring on the segment. For example, each segment associated with the directive can include a second event count. In another embodiment, each segment associated with the directive can include a first event count and a second event count. The control logic 300 then proceed to step 360.

At step 360, the control logic can determine whether multiple segments are associated with the directive. If the control logic 300 determines that multiple segments are associated with the directive, the control logic 300 then proceeds to step 362. If the control logic 300 determines that multiple segments are not associated with the directive, the control logic then proceeds to step 366.

At step 362, the control logic can determine the second event counts for each segment associated with the directive. For example, the control logic 300 can identify the second event counts related to each segment associated with the directive. The control logic 300 then proceeds to step 364.

At step 364, the control logic 300 can compare the second event count of each segment associated with the directive with the second event count of each other segment associated with the directive. The control logic then proceeds to step 366.

At step 366, the control logic can determine the minimum second event count. For example, the control logic 300 can utilize the comparison made at step 364 to determine which event count of which segment is lowest. In another embodiment, if there is only a single segment associated with the directive, the control logic 300 can determine that such event count is the minimum event count. The control logic then proceeds to step 368.

At step 368, the control logic can determine whether the minimum second event count satisfies the second event threshold. For example, the second event threshold can include a particular number of second event types such that if a minimum second event count meets or exceeds such number, the second event threshold can be satisfied. If the control logic 300 determines that the second event threshold is not satisfied by the minimum second event count, the control logic 300 then proceeds back to step 366. If the control logic 300 determines that the minimum second event count satisfies the second event threshold, the control logic 300 then proceeds to step 370.

At step 370, the control logic 300 can generate an alert. For example, the control logic 300 can generate an alert indicating that the second event threshold has been satisfied. The control logic then proceeds to step 390.

At step 372, the control logic 300 can calculate the segment total force. For example, the control logic 300 can utilize the data cluster generated and/or added to at step 332 to determine a total force applied to the one or more segments. In another example, the control logic 300 can aggregate and or generate a sum of all of the forces applied such that a total force is calculated for each segment. The control logic 300 then proceeds to step 374.

At step 374, the control logic 300 can determine whether multiple segments are associated with the directive. If the control logic 300 determines that multiple segments or associated with the directive, the control logic then proceeds to step 376. If the control logic 300 determines then multiple segments are not associated with the directive, the control logic then proceeds to step 378.

At step 376, the control logic 300 can compare total forces of each segment. For example, the control logic 300 can identify and/or recognize total forces calculated for each segment at step 372. The control logic 300 then proceeds to step 378.

At step 378, the control logic 300 can determine the minimum total force. For example, the control logic 300 can utilize the comparison made in step 376 to determine the lowest force associated with a segment. In another embodiment, if multiple segments are not associated with the directive, the control logic 300 can determine that the single segment total force is the minimum total force. The control logic then proceeds to step 380.

At step 380, the control logic 300 can determine whether a force threshold is satisfied by the minimum total force determined at step 378. For example, the force threshold can be a particular force, and if the minimum total force meets or exceeds such force, the force threshold can be satisfied. If the minimum total force determined at step 378 does not satisfy the force threshold, the control logic 300 then proceeds back to step 372. If the minimum total force determined at step 378 satisfies the force threshold, the control logic 300 then proceeds to step 382.

At step 382, the control logic can generate an alert. For example, the control logic 300 can generate an alert indicating that a minimum total force satisfied the force threshold. The control logic then proceeds to step 390.

At step 384, the control logic 300 can receive time data. For example, the control logic can be synchronized with a clock that can indicate to the control logic 300 the time of day. In another embodiment, the control logic 300 can receive data related to a duration. For example, the control logic 300 can receive a start time of a directive and monitor the duration that the directive has been active. In another embodiment, the control logic 300 can receive any other time data suitable to inform the control logic 300 regarding the directive. The control logic 300 then proceeds to step 386.

At step 386, the control logic 300 can determine whether its first temporal threshold has been satisfied. For example, the temporal threshold can be a particular time of day such that if the time data received at step 384 indicates that the time of day matches the first temporal threshold, the first temporal threshold can be satisfied. In another embodiment, the first temporal threshold can be a duration threshold, such that if the time data received at step 384 indicates that a particular duration meets or exceeds the duration of the first temporal threshold, the first temporal threshold can be satisfied. If the control logic 300 determines that the first temporal threshold has not been satisfied, the control logic 300 then proceeds back to step 306. If the control logic 300 determines that the first temporal threshold has been satisfied, the control logic 300 then proceeds to step 388.

At step 388, the control logic 300 can generate an alert. For example, the control logic 300 can generate an alert indicating that the first temporal threshold has been satisfied. The control logic 300 then proceeds to step 390.

At step 390, the control logic 300 can determine directive modification. For example, the control logic can determine what type of directive modification to instantiate based on which threshold has been satisfied. For example, and in one embodiment, if the force threshold was satisfied at step 380, the control logic 300 can determine that the directive should be lifted, such as if the directive is a slow order. In another embodiment, and as one example, if the first event threshold was satisfied at step 348, the control logic 300 can determine that directive should be modified to allow a higher speed, such as if the directive is a slow order. In another embodiment, and as one example, if the second event threshold was satisfied at step 368, the control logic 300 can determine that the directive should be modified, such as to lift the directive if the directive is a slow order. In another embodiment, the control logic 300 can determine any other appropriate type of directive modification based on the thresholds utilized and any or all of steps 348, 368, 380, 386, and/or 392. The control logic then proceeds to step 392 and to step 396.

At step 392, the control logic 300 can determine if a second temporal threshold is satisfied. For example, if the directive modification determined at step 390 was due to the first temporal threshold being satisfied in step 386, the control logic can utilize the second temporal threshold to determine whether the directive should be re-instantiated after the second temporal threshold is satisfied. In another embodiment, the second temporal threshold can be a time threshold and/or a duration threshold, similar to the first temporal threshold. In another embodiment, the second temporal threshold can be any appropriate temporal threshold. If the control logic 300 determines that the second temporal threshold is not satisfied, the control logic 300 then proceeds back to step 306. If the control logic 300 determines that the second temporal threshold is satisfied, the control logic then proceeds to step 394.

At step 394, the control logic 300 can generate an alert. For example, the control logic 300 can generate an alert indicating that the second temporal threshold is satisfied. The control logic then proceeds to step 390.

At step 396, the control logic 300 can instantiate a directive modification. For example, the control logic can utilize the determination made at step 390 with respect to the type of directive modification and instantiate such modification at step 396. For example, the control logic 300 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 300. The control logic 300 then proceeds to step 398.

At step 398, the control logic 300 can generate an alert. For example, the control logic can generate an alert indicating that a directive modification was instantiated at step 396. The control logic 300 can then terminate or repeat any of the aforementioned steps.

Figure 4A:
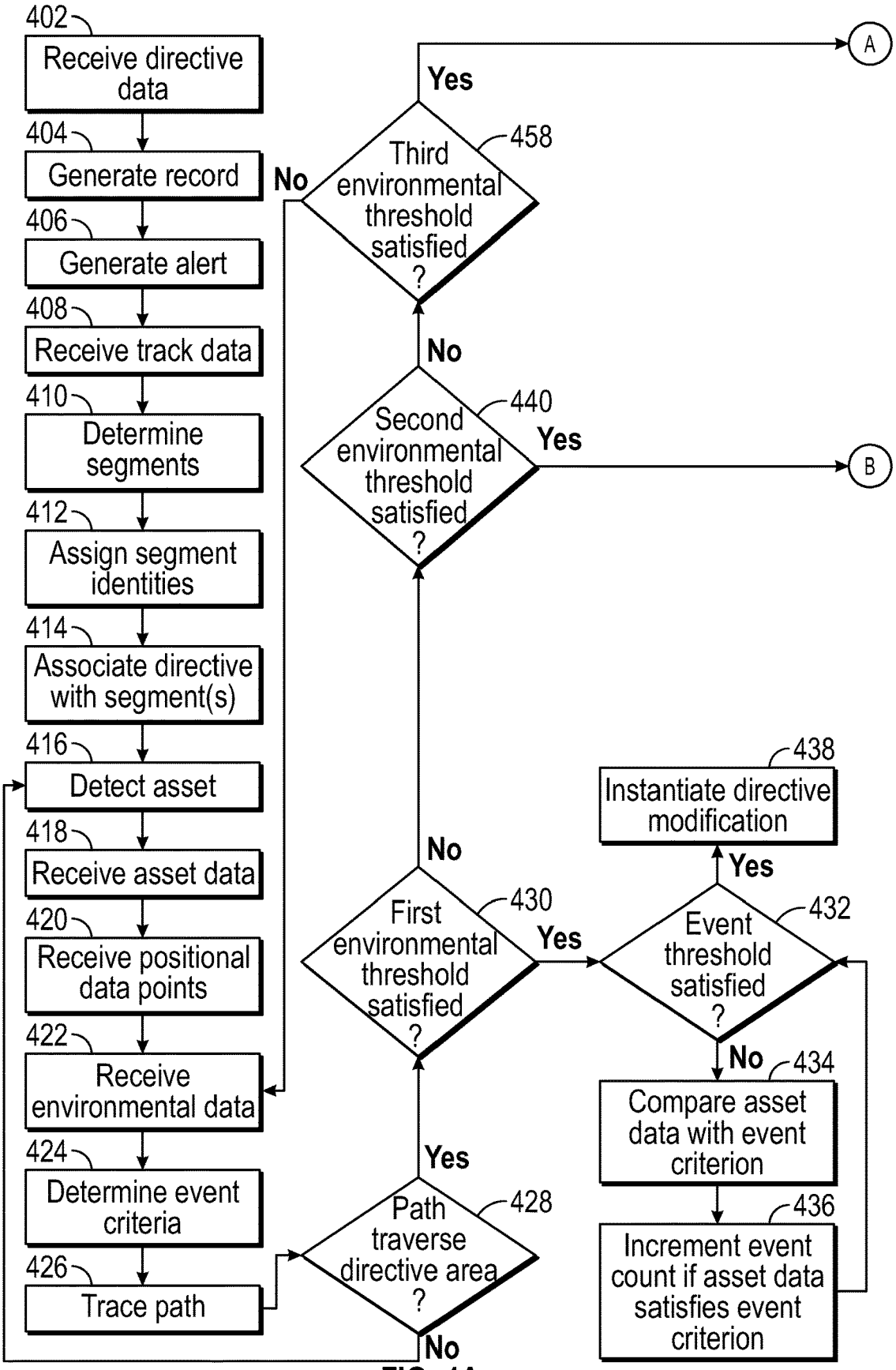
FIG. 4A illustrates a flowchart exemplifying a directive modification system, in accordance with one or more exemplary embodiments of the present disclosure.
Figure 4B:
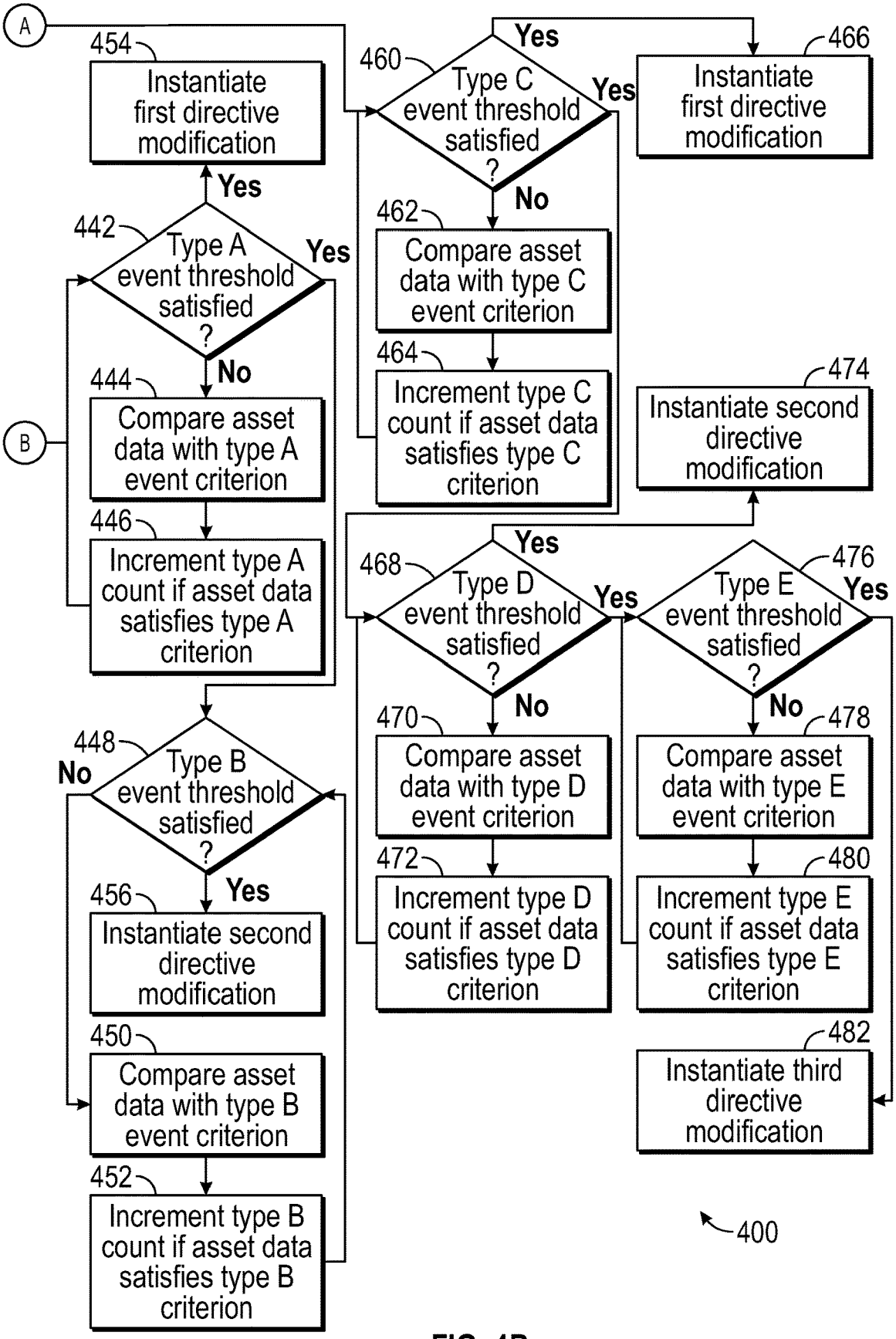
FIG. 4B illustrates a flowchart exemplifying a directive modification system, in accordance with one or more exemplary embodiments of the present disclosure.

FIG. 4A and FIG. 4B illustrates a flow chart diagram 400 exemplifying control logic embodying features of a directive modification system 400, in accordance with an exemplary embodiment of the present disclosure. The directive modification control logic 400 can be implemented as an algorithm on a server (e.g., server 102), a machine learning module, or other suitable system. Additionally, the directive modification control logic 400 can implement or incorporate one or more features of the compaction-related slow order management system 200, including the directive management system 202, the compaction tracking system 204, and the alert management system 206. The directive modification control logic 400 can be achieved with software, hardware, an application programming interface (API), a network connection, a network transfer protocol, HTML, DHTML, JavaScript, Dojo, Ruby, Rails, other suitable applications, or a suitable combination thereof.

The directive modification control logic 400 can leverage the ability of a computer platform to spawn multiple processes and threads by processing data simultaneously. The speed and efficiency of the directive modification control logic 400 is greatly improved by instantiating more than one process to facilitate personnel safety. However, one skilled in the art of programming will appreciate that use of a single processing thread may also be utilized and is within the scope of the present disclosure.

The directive modification control logic 400 of the present embodiment begins at step 402. At step 402, the control logic 400 can receive directive data. For example, the control logic 400 can receive the type of directive, the instructions of the directive, the portion of track with which the directive is associated, track segments with which the directive data is associated with, or any other data related to the directive. For example, the control logic 400 can receive that the directive is a slow order that can instruct vehicles to reduce speed on a particular portion of railroad track. In another embodiment, the control logic 400 can receive data related to how the directive can be modified and/or terminated. For example, the control logic 400 can receive data or related to a force threshold needed to be satisfied to modify the directive. In another example, the control logic 400 can receive an event count threshold and/or event threshold that must be satisfied for the directive to be modified and/or lifted. The control logic 400 then proceeds to step 404.

At step 404, the control logic 400 can generate a record. For example, the record can include the directive, and/or data related to the directive. In one embodiment, the record can include a time and date of the directive, instructions of the directive, and/or any other data related to the directive. In another embodiment, the record generated at step 404 can be configured to store additional data generated and/or modified by the control logic 400. In this manner, the record generated at step 404 can include the directive and associated data as well as events and or vehicles and or any other data related to the directive and/or modification thereof. The control logic 400 then proceeds to step 406.

At step 406, the control logic 400 can generate an alert. For example, the control logic 400 can determine that because directive data was received, and alert should be generated. In another embodiment, the control logic 400 can transmit the alert among the railroad system and/order to railroad personnel. For example, the control logic 400 can notify one or more systems as well as associated personnel that a directive has been instantiated with respect to a particular portion of railroad track. The control logic 400 then proceeds to step 408.

At step 408, the control logic 400 can receive track data. For example, the control logic 400 can receive track location data, track segment data, track segment identification data, track type, track condition, or any other data related to the track. The control logic 400 then proceeds to step 410.

At step 410, the control logic 400 can determine segments. For example, the control logic 400 can receive data related to a particular length of track at step 408 and determine how such length of track is to be segmented at step 410. For example, the control logic 400 can receive as indications in the track data how the length of track should be segmented. In another embodiment, the control logic 400 can decide based on track data how the track should be segmented. For example, the control logic 400 can determine that a mainline and a siding are both present and further determine that a piece of the main line should be a different segment from the siding. In another embodiment, the control logic 400 can determine that a segment should be a particular length, such that a portion of track can be split up into segments by segment length. I another embodiment, the control logic 400 can determine segments by any suitable mechanism, including the presence of particular equipment, tie composition, rail type, age, or any other criteria suitable to enable the control logic 400 to segment a portion of railroad track into one or more segments. In another embodiment, the control logic 400 can determine track segments in any manner suitable to enable directive governance. The control logic 400 then proceeds to have 412.

At step 412, the control logic 400 can assign segment identities. For example, the control logic can assign identifiers to the segments determined at step 410. In another embodiment, the control logic 400 can receive indications from the track data of how each segment should be identified. In another embodiment, the control logic 400 can assign identification numbers to each segment. In another embodiment, the control logic 400 can identify and/or assigned segment identities and any manner suitable to allow the control logic 400 to distinguish between one or more track segments. The control logic 400 then proceeds to step 414.

At step 414, the control logic 400 can associate a directive with one or more track segments. For example, the control logic can utilize the directive data received in step 402 to determine with which length of track the directive should be associated with. The control logic 400 can then utilize track data received at step 408, segments determined at step 410, and segment identities determined in step 412 to determine with which segments the directive should be associated with. For example, the control logic 400 can determine which segments are covered by the directive. The control logic 400 then proceeds to step 416.

At step 416, the control logic 400 can detect an asset. For example, the control logic 400 can detect a vehicle on a track. In another example, the control logic 400 can be in operable communication with one or more sensors, systems, or any other components suitable to detect a vehicle and/or other asset. The control logic 400 then proceeds to step 418.

At step 418, the control logic 400 can receive asset data. For example, the control logic 400 can receive data related to identification of the asset, a load the asset is carrying, a speed the asset is traveling, or any other data related to the asset. In another embodiment, the control logic 400 can be in operable communication with any number of sensors or other data collectors to capture and/or receive data related to the asset. The control logic 400 then proceeds to step 420.

At step 420, the control logic 400 can receive positional data points. For example, the control logic 400 can receive data points related to the position of detection of the asset. For example, the control logic 400 can be in communication with one or more sensors configured to read an electrical current in the track, and the control logic 400 can utilize such sensors to detect position of an asset on the track. In another embodiment, the control logic can utilize a Global Positioning System, radar, low energy Bluetooth, or any other type of communication and/or protocol and/or data to determine positions of assets on railroad tracks. In another embodiment, the control logic 400 can receive positional data points that can be associated with particular track segments determined and/or identified in steps 410 and 412. For example, the control logic 400 can receive positional data points at step 420 that indicate and asset's position on a particular track segment. The control logic 400 then proceeds to step 422.

At step 422, the control logic 400 can receive environmental data. For example, the control logic 400 can be in operable communication with one or more sensors configured to capture environmental data. In another example, environmental data can include humidity, temperature, weather, climate, pressure, or any other environmental data. In another embodiment, the control logic 400 can receive data from one or more other systems that can be configured to collect environmental data and transmit such data to the control logic 400. The control logic 400 then proceeds to step 424.

At step 424, the control logic 400 can determine event criteria. For example, the control logic 400 can determine one or more types of events to count. For example, the control logic 400 can receive indications from other systems and/or personnel as to which events should be counted. In another example, the control logic 400 can include criteria related to one or more event types. In another embodiment, the control logic 400 can determine that a more than one type of event should be counted. For example, the control logic 400 can determine that the event criteria include vehicles traveling at a particular velocity. In another example, the control logic 400 can determine that the event criteria include vehicles traveling with a particular load. In another embodiment, the control logic 400 can determine that event criteria include a vehicle traveling at a particular speed and having a particular load. In another embodiment, the control logic 400 can utilize any other criteria relevant to the directive and/or modification thereof. In another embodiment, the control logic 400 can utilize any event criteria suitable to enable the control logic 400 to track compaction of the ballast and/or determine whether a directive should be modified and/or terminated. The control logic 400 then proceeds to step 426.

At step 426, the control logic 400 can trace a path. For example, the control logic can utilize the positional data points received in step 420 to trace a path along a railroad track. For example, the control logic 400 can receive positional data points and/or recognize that an asset is and/or was present on a particular track segment, and further trace a path along the track using the identified track segments. For example, the control logic 400 can receive positional data points indicating that an asset is and/or was located on two separate track segments. The control logic 400 can then trace a path between such two track segments and determine if the path traverses a third track segment. In this manner, the control logic 400 can determine a path of and asset along one or more track segments of a railroad track. In another embodiment, in this manner, the control logic 400 can determine events and/or forces applied to one or more track segments even if the control logic 400 did not receive positional data points at step 326 that directly indicated that an asset traveled along a particular track segment. The control logic 400 then proceeds to step 428.

At step 428, the control logic 400 can determine whether a path traced at step 426 traversed a segment associated with the directive. For example, the control logic can compare a path traced in step 426 with the segments associated with the directive at step 414 and determine whether any of the segments traversed by the path are/were associated with the directive. The control logic 400 proceeds to step 416 if the control logic 400 determines that the path traced at step 426 does not traverse one or more segments associated with the directive. The control logic 400 then proceeds to step 430 if the control logic 400 determines that the path traced at step 426 traverses one or more segments associated with the directive.

At step 430, the control logic 400 can determine whether the environmental data received in step 422 satisfies of first environmental threshold. For example, the environmental threshold can be a temperature threshold. For example, environmental data can include a rail temperature, and/or an ambient temperature that can affect rail temperature. In another example, environmental data can include a UV index, e.g. data that can indicate an amount of sun and/or radiation, such as could affect rail temperature. For example, if the environmental data indicates a particular temperature, the environmental threshold can be a particular temperature such that if the environmental data meets or exceeds a particular temperature, the environmental threshold can be satisfied. In another embodiment, the first environmental threshold can be a humidity threshold, such that if the environmental data received at step 422 indicates particular humidity, and the humidity meets or exceeds the humidity of the environmental threshold, the second environmental threshold can be satisfied. In another embodiment, the first environmental threshold can be any suitable environmental threshold. if the control logic determines that the first environmental threshold is satisfied, the control logic then proceeds to step 432. If the control logic 400 determines that the first environmental threshold is not satisfied, the control logic 400 then proceeds to step 440.

At step 432, the control logic can determine whether an event threshold is satisfied. For example, the control logic 400 can utilize an event count determined and compare such event count with the event threshold to determine whether the event threshold is satisfied. In this manner, the control logic 400 can ensure that one or more segments associated with particular directive either meets or exceeds the event threshold such that a directive is not lifted and/or modified prematurely. If the control logic 400 determines that the event threshold is satisfied, the control logic 400 then proceeds to step 438. If the control logic 400 determines that the event threshold is not satisfied, the control logic then proceeds to step 434.

At step 434, the control logic 400 can compare the asset data with one or more event criteria. For example, the control logic 400 can utilize the asset data received at step 418 and compare such data with event criteria determined in step 424. In one embodiment, multiple criteria can be associated with an event. In another embodiment, a single criterion can be associated with an event. The control logic 400 then proceeds to step 436.

At step 436, the control logic 400 can increment an event count if the asset data received at step 418 satisfies the event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain an event count for events satisfying event criteria. The control logic 400 then proceeds to step 432.

At step 438, the control logic 400 can instantiate a directive modification. For example, the control logic can utilize the determination made at step 432 that an event count threshold was satisfied and instantiate such modification at step 438. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

At step 440, the control logic 400 can determine whether the environmental data received in step 422 satisfies of second environmental threshold. For example, the environmental threshold can be a temperature threshold. For example, environmental data can include a rail temperature, and/or an ambient temperature that can affect rail temperature. In another example, environmental data can include a UV index, e.g. data that can indicate an amount of sun and/or radiation, such as could affect rail temperature. For example, if the environmental data indicates a particular temperature, the environmental threshold can be a particular temperature such that if the environmental data meets or exceeds a particular temperature, the environmental threshold can be satisfied. In another embodiment, the second environmental threshold can be a humidity threshold, such that if the environmental data received at step 422 indicates particular humidity, and the humidity meets or exceeds the humidity of the environmental threshold, the second environmental threshold can be satisfied. In another embodiment, the second environmental threshold can be any suitable environmental threshold. If the control logic determines that the second environmental threshold is satisfied, the control logic then proceeds to step 442. If the control logic 400 determines that the second environmental threshold is not satisfied, the control logic 400 then proceeds to step 440.

At step 442, the control logic can determine whether an event threshold is satisfied. For example, the event thresholds can be related to counted Type A events. In one embodiment, Type A events can include different criteria as compared to, e.g., events compared to an event threshold in step 432. For example, event criteria for Type A events can be different, such as because the second environmental threshold was satisfied as determined in step 440. For example, event criteria can include increased or reduced speed limits, weight limits, or any other criteria. For example, the control logic 400 can utilize an event count determined and compare such event count with the event threshold to determine whether the Type A event threshold is satisfied. In this manner, the control logic 400 can ensure that one or more segments associated with particular directive either meets or exceeds the Type A event threshold such that a directive is not lifted and/or modified prematurely. If the control logic 400 determines that the event threshold is satisfied, the control logic 400 then proceeds to step 456. If the control logic 400 determines that the event threshold is not satisfied, the control logic then proceeds to step 444.

At step 444, the control logic 400 can compare the asset data with one or more Type A event criteria. For example, the control logic 400 can utilize the asset data received at step 418 and compare such data with Type A event criteria determined in step 424. In one embodiment, multiple criteria can be associated with a Type A event. In another embodiment, a single criterion can be associated with a Type A event. The control logic 400 then proceeds to step 446.

At step 446, the control logic 400 can increment a Type A event count if the asset data received at step 418 satisfies the Type A event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain a Type A event count for events satisfying Type A event criteria. The control logic 400 then proceeds to step 442.

At step 448, the control logic can determine whether an event threshold is satisfied. For example, the event thresholds can be related to counted Type B events. In one embodiment, Type B events can include different criteria as compared to, e.g., events compared to an event threshold in step 432 and/or step 442. For example, event criteria for Type B events can be different, such as because the second environmental threshold was satisfied as determined in step 440 and the Type A event threshold was satisfied. For example, event criteria can include increased or reduced speed limits, weight limits, or any other criteria. For example, the control logic 400 can utilize an event count determined and compare such event count with the event threshold to determine whether the Type B event threshold is satisfied. In this manner, the control logic 400 can ensure that one or more segments associated with particular directive either meets or exceeds the Type B event threshold such that a directive is not lifted and/or modified prematurely. If the control logic 400 determines that the event threshold is satisfied, the control logic 400 then proceeds to step 456. If the control logic 400 determines that the event threshold is not satisfied, the control logic then proceeds to step 450.

At step 450, the control logic 400 can compare the asset data with one or more Type B event criteria. For example, the control logic 400 can utilize the asset data received at step 418 and compare such data with Type B event criteria determined in step 424. In one embodiment, multiple criteria can be associated with a Type B event. In another embodiment, a single criterion can be associated with a Type B event. The control logic 400 then proceeds to step 452.

At step 452, the control logic 400 can increment a Type B event count if the asset data received at step 418 satisfies the Type B event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain a Type B event count for events satisfying Type B event criteria. The control logic 400 then proceeds to back step 448.

At step 454, the control logic 400 can instantiate a first directive modification. For example, the control logic can utilize the determination made at step 442 that a Type A event count threshold was satisfied and instantiate a first modification at step 454. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

At step 456, the control logic 400 can instantiate a second directive modification. For example, the second directive modification can be different from or the same as the first directive modification at step 454 and/or directive modification at step 438. For example, the control logic can utilize the determination made at step 442 that a Type B event count threshold was satisfied and instantiate a second modification at step 456. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

At step 458, the control logic 400 can determine whether the environmental data received in step 422 satisfies of third environmental threshold. For example, the environmental threshold can be a temperature threshold. For example, environmental data can include a rail temperature, and/or an ambient temperature that can affect rail temperature. In another example, environmental data can include a UV index, e.g. data that can indicate an amount of sun and/or radiation, such as could affect rail temperature. For example, if the environmental data indicates a particular temperature, the environmental threshold can be a particular temperature such that if the environmental data meets or exceeds a particular temperature, the environmental threshold can be satisfied. In another embodiment, the third environmental threshold can be a humidity threshold, such that if the environmental data received at step 422 indicates particular humidity, and the humidity meets or exceeds the humidity of the environmental threshold, the second environmental threshold can be satisfied. In another embodiment, the third environmental threshold can be any suitable environmental threshold. if the control logic determines that the third environmental threshold is satisfied, the control logic then proceeds to step 460. If the control logic 400 determines that the third environmental threshold is not satisfied, the control logic 400 then proceeds to step 460.

At step 460, the control logic can determine whether an event threshold is satisfied. For example, the event thresholds can be related to counted Type C events. In one embodiment, Type C events can include different criteria as compared to, e.g., events compared to an event threshold in steps 432, 442, and/or 448. For example, event criteria for Type C events can be different, such as because the third environmental threshold was satisfied as determined in step 440. For example, event criteria can include increased or reduced speed limits, weight limits, or any other criteria. For example, the control logic 400 can utilize an event count determined and compare such event count with the event threshold to determine whether the Type C event threshold is satisfied. In this manner, the control logic 400 can ensure that one or more segments associated with particular directive either meets or exceeds the Type C event threshold such that a directive is not lifted and/or modified prematurely. If the control logic 400 determines that the event threshold is satisfied, the control logic 400 then proceeds to step 468. If the control logic 400 determines that the event threshold is not satisfied, the control logic then proceeds to step 462.

At step 462, the control logic 400 can compare the asset data with one or more Type C event criteria. For example, the control logic 400 can utilize the asset data received at step 418 and compare such data with Type C event criteria determined in step 424. In one embodiment, multiple criteria can be associated with a Type C event. In another embodiment, a single criterion can be associated with a Type C event. The control logic 400 then proceeds to step 464.

At step 464, the control logic 400 can increment a Type C event count if the asset data received at step 418 satisfies the Type C event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain a Type C event count for events satisfying Type C event criteria. The control logic 400 then proceeds to step 460.

At step 466, the control logic 400 can instantiate a first directive modification. For example, the control logic can utilize the determination made at step 460 that a Type C event count threshold was satisfied and instantiate a first modification at step 466. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

At step 468, the control logic 400 can determine whether an event threshold is satisfied. For example, the event thresholds can be related to counted Type D events. In one embodiment, Type D events can include different criteria as compared to, e.g., events compared to an event threshold in step 432 and/or step 460. For example, event criteria for Type D events can be different, such as because the second environmental threshold was satisfied as determined in step 440 and the Type C event threshold was satisfied. For example, event criteria can include increased or reduced speed limits, weight limits, or any other criteria. For example, the control logic 400 can utilize an event count determined and compare such event count with the event threshold to determine whether the Type D event threshold is satisfied. In this manner, the control logic 400 can ensure that one or more segments associated with particular directive either meets or exceeds the Type D event threshold such that a directive is not lifted and/or modified prematurely. If the control logic 400 determines that the event threshold is satisfied, the control logic 400 then proceeds to step 476. If the control logic 400 determines that the event threshold is not satisfied, the control logic then proceeds to step 470.

At step 470, the control logic 400 can compare the asset data with one or more Type D event criteria. For example, the control logic 400 can utilize the asset data received at step 418 and compare such data with Type D event criteria determined in step 424. In one embodiment, multiple criteria can be associated with a Type D event. In another embodiment, a single criterion can be associated with a Type D event. The control logic 400 then proceeds to step 472.

At step 472, the control logic 400 can increment a Type D event count if the asset data received at step 418 satisfies the Type D event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain a Type D event count for events satisfying Type D event criteria. The control logic 400 then proceeds to step 460.

At step 474, the control logic 400 can instantiate a second directive modification. For example, the second directive modification can be different from or the same as the first directive modification at step 454 and/or directive modification at step 438. For example, the control logic can utilize the determination made at step 468 that a Type D event count threshold was satisfied and instantiate a second modification at step 474. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

At step 476, the control logic 400 can determine whether an event threshold is satisfied. For example, the event thresholds can be related to counted Type E events. In one embodiment, Type E events can include different criteria as compared to, e.g., events compared to an event threshold in step 432 and/or step 460 and/or any of the other events in the steps described herein. For example, event criteria for Type E events can be different, such as because the third environmental threshold was satisfied as determined in step 440 and the Type D event threshold was satisfied. For example, event criteria can include increased or reduced speed limits, weight limits, or any other criteria. For example, the control logic 400 can utilize an event count determined and compare such event count with the event threshold to determine whether the Type E event threshold is satisfied. In this manner, the control logic 400 can ensure that one or more segments associated with particular directive either meets or exceeds the Type E event threshold such that a directive is not lifted and/or modified prematurely. If the control logic 400 determines that the event threshold is satisfied, the control logic 400 then proceeds to step 476. If the control logic 400 determines that the event threshold is not satisfied, the control logic then proceeds to step 478.

At step 478, the control logic 400 can compare the asset data with one or more Type E event criteria. For example, the control logic 400 can utilize the asset data received at step 418 and compare such data with Type E event criteria determined in step 424. In one embodiment, multiple criteria can be associated with a Type E event. In another embodiment, a single criterion can be associated with a Type E event. The control logic 400 then proceeds to step 480.

At step 480, the control logic 400 can increment a Type E event count if the asset data received at step 418 satisfies the Type E event criteria determined at step 424. For example, the control logic 400 can keep track of qualifying events for each segment associated with the directive. For example, the control logic 400 can associate one or more event counts with any particular segment and count the number of events satisfying particular event criteria. In another embodiment, the control logic 400 can maintain a Type E event count for events satisfying Type E event criteria. The control logic 400 then proceeds back to step 476.

At step 482, the control logic 400 can instantiate a third directive modification. For example, the third directive modification can be different from or the same as the first directive modification at step 466 and/or second directive modification at step 474 and/or directive modification at step 438. For example, the control logic can utilize the determination made at step 476 that a Type E event count threshold was satisfied and instantiate a third modification at step 482. For example, the control logic 400 can modify a maximum speed of a slow order, terminate a directive, modify a directive to include additional instructions, modify a directive to remove instructions, modify a directive to require maintenance, and/or perform any other directive modification suitable to address the satisfaction or lack thereof of thresholds utilized by the control logic 400. The control logic 400 can then terminate or repeat any of the aforementioned steps.

Figure 5:
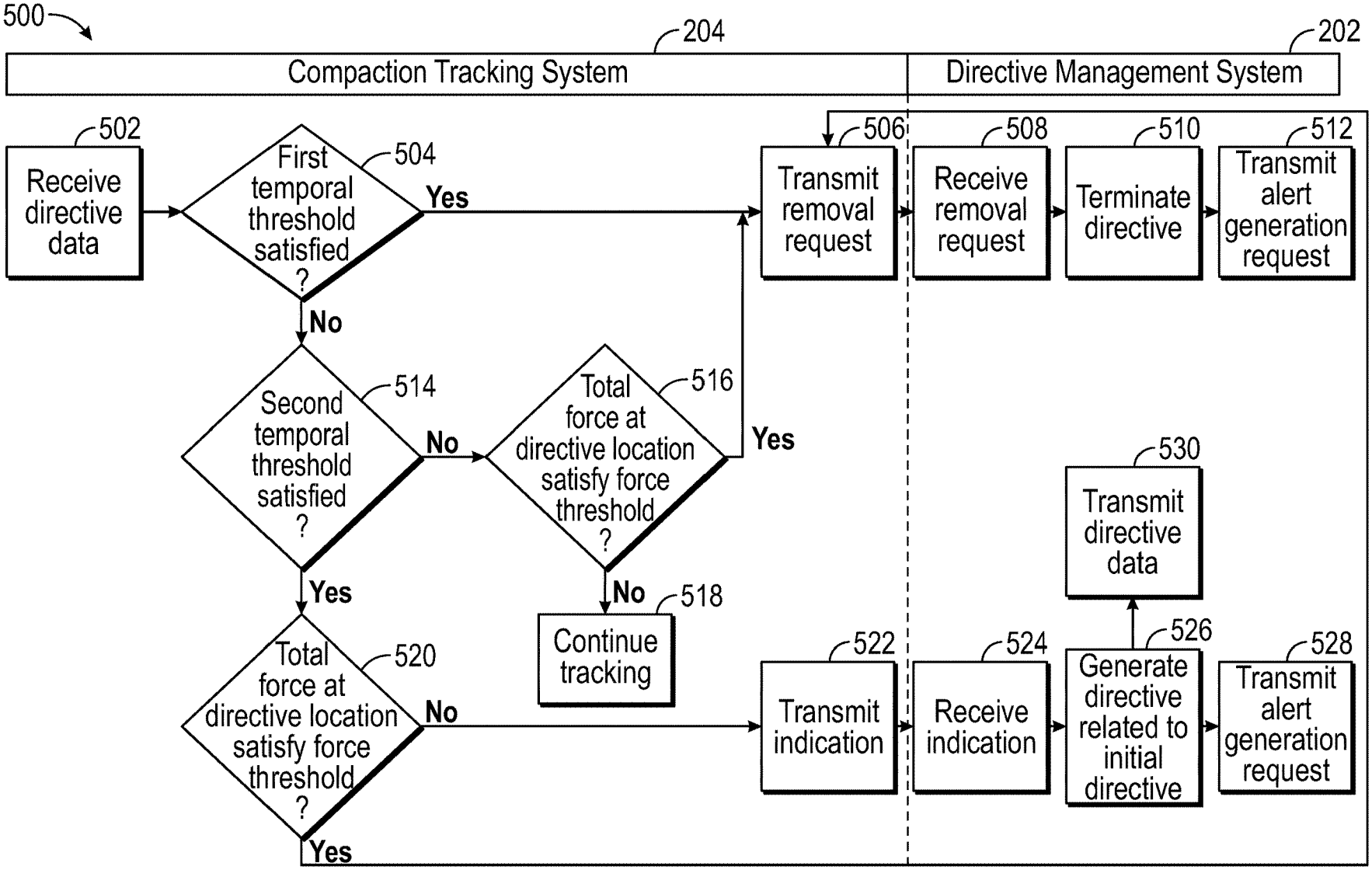
FIG. 5 illustrates a flowchart exemplifying a compaction oversight system, in accordance with one or more exemplary embodiments of the present disclosure.

FIG. 5 illustrates a flow chart diagram 500 exemplifying control logic embodying features of a compaction oversight system 500, in accordance with an exemplary embodiment of the present disclosure. The compaction oversight control logic 500 can be implemented as an algorithm on a server (e.g., server 102), a machine learning module, or other suitable system. Additionally, the compaction oversight control logic 500 can implement or incorporate one or more features of the compaction-related slow order management system 200, including the directive management system 202, and/or the compaction tracking system 204, and/or the alert management system 206. The compaction oversight control logic 500 can be achieved with software, hardware, an application programming interface (API), a network connection, a network transfer protocol, HTML, DHTML, JavaScript, Dojo, Ruby, Rails, other suitable applications, or a suitable combination thereof.

The compaction oversight control logic 500 can leverage the ability of a computer platform to spawn multiple processes and threads by processing data simultaneously. The speed and efficiency of the compaction oversight control logic 500 is greatly improved by instantiating more than one process to facilitate personnel safety. However, one skilled in the art of programming will appreciate that use of a single processing thread may also be utilized and is within the scope of the present disclosure.

The compaction oversight control logic 500 process flow of the present embodiment begins at step 502, wherein the control logic 500 receives directive data. For example, the control logic 500 can receive the type of directive, the instructions of the directive, the portion of track with which the directive is associated, track segments with which the directive data is associated with, or any other data related to the directive. For example, the control logic 500 can receive that the directive is a slow order that can instruct vehicles to reduce speed on a particular portion of railroad track. In another embodiment, the control logic 500 can receive data related to how the directive can be modified and/or terminated. For example, the control logic 500 can receive data or related to a force threshold needed to be satisfied to modify the directive. In another example, the control logic 500 can receive an event count threshold and/or event threshold that must be satisfied for the directive to be modified and/or lifted. In one embodiment, the directive can be a slow order. The control logic 500 then proceeds to step 504.

At step 504, the control logic 500 can determine whether its first temporal threshold has been satisfied. For example, the temporal threshold can be a particular time of day such that if the time of day matches the first temporal threshold, the first temporal threshold can be satisfied. In another embodiment, the first temporal threshold can be a duration threshold, such that if a particular duration meets or exceeds the duration of the first temporal threshold, the first temporal threshold can be satisfied. If the control logic 500 determines that the first temporal threshold has not been satisfied, the control logic 500 then proceeds to step 514. If the control logic 500 determines that the first temporal threshold has been satisfied, the control logic 500 then proceeds to step 506.

At step 506, the control logic 500 can transmit a removal request. For example, the control logic 500 can transmit a removal request to the directive management system 202. In one embodiment, the removal request can carry instructions for the directive management system 202 to instantiate the removal of the directive and/or disassociation of the directive from one or more track segments. In another embodiment, the removal request transmitted by the control logic 500 at step 506 can indicate to railroad personnel that the director should be removed such that the personnel can remove the directive. The control logic 500 then proceeds to step 508

At step 508, the control logic 500 can receive the removal request. For example, the directive management system 202 can receive the removal request. In one embodiment, reception of a removal request can indicate to the control logic 500 that the directive should be removed. The control logic then proceeds to step 510.

At step 510, the control logic 500 can terminate the directive. For example, if the directive is a slow order, the control logic 500 can abrogate the slow order such that there is no longer a reduced speed on one or more track segments. In another embodiment, the control logic 500 can request termination via personnel or another system. The control logic 500 then proceeds to step 512.

At step 512, the control logic 500 can transmit an alert generation request. For example, the control logic 500 can transmit an alert generation request to the alert management system 206. In another embodiment, the control logic 500 can transmit an alert generation request to one or more systems and/or personnel in communication with the control object 500. The control logic 500 can then terminate or repeat any of the aforementioned steps.

At step 514, the control logic 500 can determine if a second temporal threshold is satisfied. For example, the control logic 500 can utilize the second temporal threshold to determine whether the directive should be re-instantiated after the second temporal threshold is satisfied. In another embodiment, the second temporal threshold can be a time threshold and/or a duration threshold, similar to the first temporal threshold. In another embodiment, the second temporal threshold can be any appropriate temporal threshold. If the control logic 500 determines that the second temporal threshold is not satisfied, the control logic 500 then proceeds to step 516. If the control logic 500 determines that the second temporal threshold is satisfied, the control logic then proceeds to step 520.

At step 516, the control logic 500 can determine whether a force threshold is satisfied by a total force. For example, the force threshold can be a particular force, and if the total force meets or exceeds such force, the force threshold can be satisfied. If the total force determined at step 516 does not satisfy the force threshold, the control logic 500 then proceeds to step 518. If the total force determined satisfies the force threshold, the control logic 500 then proceeds to step 506.

At step 518, the control logic 500 can continue to track applied forces on a track associated with a directive location. For example, the control logic 500 can determine that the total force so far applied to a track at the directive location does not exceed a force threshold in step 516, the control logic 500 can thereby determine that the total force should continue to be tracked. The control logic 500 can then terminate or repeat any of the aforementioned steps.

At step 520, the control logic 500 can determine whether a force threshold is satisfied by a total force. For example, the force threshold can be a particular force, and if the total force meets or exceeds such force, the force threshold can be satisfied. If the total force determined at step 520 does not satisfy the force threshold, the control logic 500 then proceeds to step 522. If the total force determined satisfies the force threshold, the control logic 500 then proceeds to step 506.

At step 522, the control logic 500 can transmit an indication. For example, and indication can include an indication that the force threshold remains unsatisfied. The control logic 500 then proceeds to step 524.

At step 524, the control logic 500 can receive an indication. For example, the control logic 500 can receive an indication there was transmitted at step 522. In another embodiment, the control logic 500 can receive an indication that a forced threshold has not been satisfied. In another embodiment, the control logic 500 and/or the directive management system 202 can receive an indication. The control logic 500 then proceeds to step 526.

At step 526, the control logic 500 can generate a directive related to the first directive. For example, the directive generated at step 526 can include the same or similar parameters as to the directive and/or data received at step 502. In another embodiment, the directive generated at step 526 can include a related total force count and/or measurement, such that modification and/or termination of the directive generated at step 526 can, in one example, depend at least in part on satisfaction of the force threshold by the total force measurement. In another embodiment, the total force measurement associated with the initial directive can carry over to the directive generated at step 526. The control logic 500 then proceeds to step 528 and step 530.

At step 528, the control logic 500 can transmit an alert generation request. For example, the control logic 500 can transmit an alert generation request to an alert management system. In another embodiment, the control logic 500 can indicate to one or more systems that an alert should be generated because a new directive was generated at step 526. The control logic 500 can then terminate or repeat any of the aforementioned steps.

At step 530, the control logic 500 can transmit directive data. For example, the control logic 500 can transmit data related to the directive generated at step 526. The control logic 500 can then terminate or repeat any of the aforementioned steps.

In one embodiment, the control logic 500 can enable the removal and reinstatement of directives based on the time of day and/a force threshold. For example, the control logic 500, utilizing the process flow 500, can request that a directive be removed, such as if night has fallen or a particular time of day has been reached. While the directive is removed, the control logic 500 can continue to track the total force applied on a track at the directive location. In another embodiment, when another time of day has been reached, such as morning time, the control logic 500 can first check if a force threshold has been satisfied, and if it has been satisfied, the control logic 500 can request that the directive remain removed. In another embodiment, after the second temporal threshold has been satisfied and if the total force threshold has not been satisfied, the control logic can transmit an indication that the force threshold remains unsatisfied. In another embodiment, the control logic 500 can use this indication to instantiate a new directive having similar parameters and/or that is otherwise related to the first directive, such as to continue a slow order on the track because the force threshold still is not satisfied but the temporal threshold is. In this manner, the control logic 500 can selectively reestablish a directive that has been lifted due to one or more temporal thresholds being satisfied as determined by a force threshold.

Figure 6:
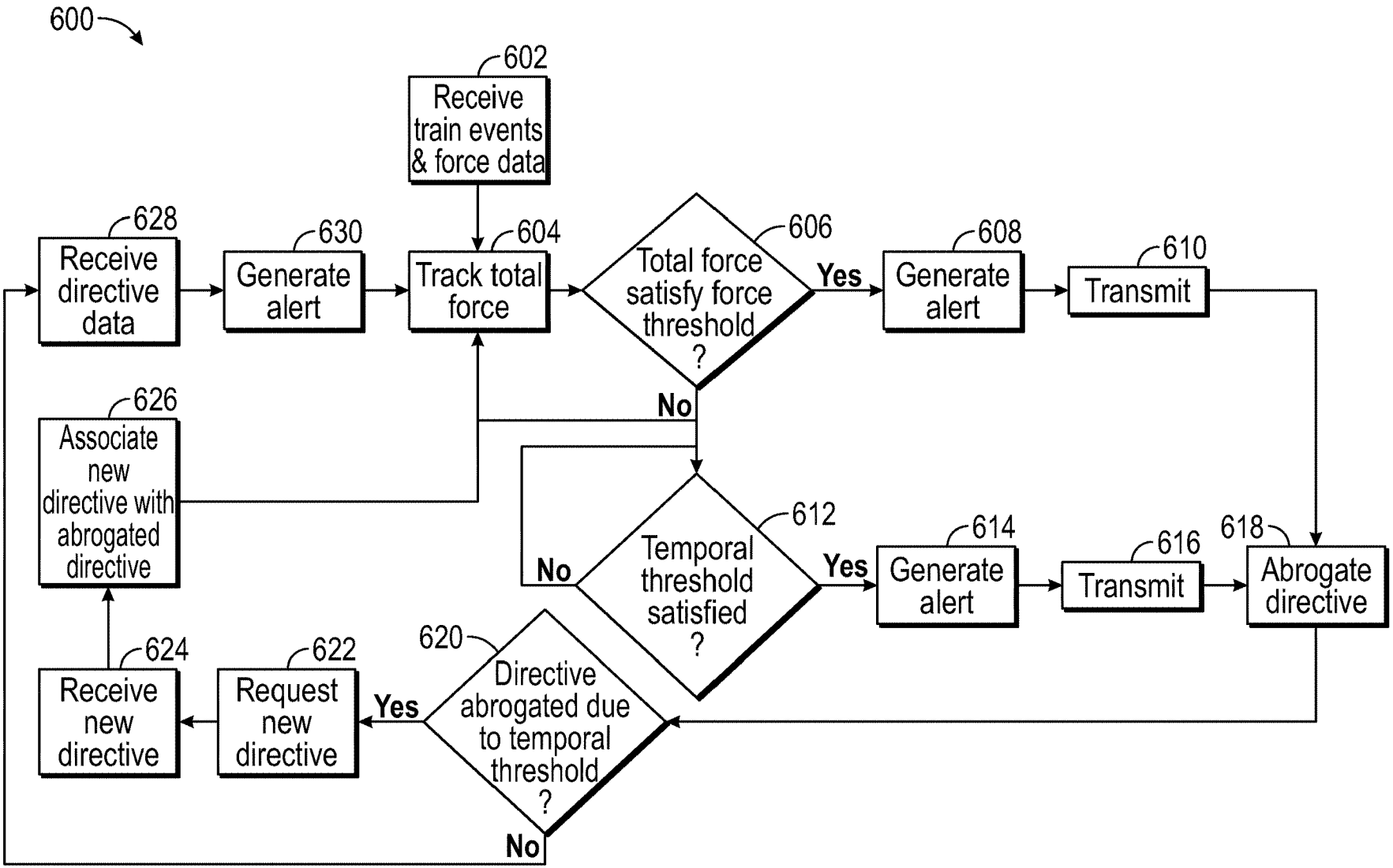
FIG. 6 illustrates a flowchart exemplifying a force tracking system, in accordance with one or more exemplary embodiments of the present disclosure.

FIG. 6 illustrates a flow chart diagram 600 exemplifying control logic embodying features of a force tracking system 600, in accordance with an exemplary embodiment of the present disclosure. The force tracking control logic 600 can be implemented as an algorithm on a server (e.g., server 102), a machine learning module, or other suitable system. Additionally, the force tracking control logic 600 can implement or incorporate one or more features of the compaction-related slow order management system 200, including the directive management system 202, the compaction tracking system 204, and the alert management system 206. The force tracking control logic 600 can be achieved with software, hardware, an application programming interface (API), a network connection, a network transfer protocol, HTML, DHTML, JavaScript, Dojo, Ruby, Rails, other suitable applications, or a suitable combination thereof.

The force tracking control logic 600 can leverage the ability of a computer platform to spawn multiple processes and threads by processing data simultaneously. The speed and efficiency of the force tracking control logic 600 is greatly improved by instantiating more than one process to facilitate personnel safety. However, one skilled in the art of programming will appreciate that use of a single processing thread may also be utilized and is within the scope of the present disclosure.

The force tracking control logic 600 of the present embodiment begins at step 602, wherein the control logic 600 receives train events and force data. In one embodiment, a train event can include a train passing a track segment associated with a directive. In another embodiment, train event can include a train of a particular speed and/or particular weight traveling over a track segment associated with the directive. In another embodiment, a train event can be any other sort of train event, including a maintenance incident, a hard-braking incident, or any other type of event. In another embodiment, force data can include weight and/or force measurements of, for example, trains on the track. The control logic 600 then proceeds to step 604.

The force tracking control logic 600 of the present embodiment also begins at step 628, wherein the control logic 600 receives directive data. For example, the control logic 600 can receive the type of directive, the instructions of the directive, the portion of track with which the directive is associated, track segments with which the directive data is associated with, or any other data related to the directive. For example, the control logic 600 can receive that the directive is a slow order that can instruct vehicles to reduce speed on a particular portion of railroad track. In another embodiment, the control logic 600 can receive data related to how the directive can be modified and/or terminated. For example, the control logic 600 can receive data or related to a force threshold needed to be satisfied to modify the directive. In another example, the control logic 600 can receive an event count threshold and/or event threshold that must be satisfied for the directive to be modified and/or lifted. The control logic 600 then proceeds to step 630.

At step 630, the control logic 600 can generate an alert. For example, the control logic can generate an alert indicating that directive data has been received. In another example, the control logic 600 can generate an alert indicating that a directive has been instantiated. The control logic 600 then proceeds to step 604.

At step 604, the control logic 600 can track the total force exerted on one or more track segments, such as track segments associated with a directive. In another embodiment, the control logic 600 can maintain a total force calculation that can be incremented by the force determined and/or received at step 602. The control logic 600 then proceeds to step 606.

At step 606, the control logic 600 can determine whether a force threshold is satisfied by the total force determined at step 604. For example, the force threshold can be a particular force, and if the total force meets or exceeds such force, the force threshold can be satisfied. If the total force determined at step 604 does not satisfy the force threshold, the control logic 600 then proceeds to step 612. If the minimum total force determined at step 604 satisfies the force threshold, the control logic 600 then proceeds to step 608.

At step 608, the control logic 600 can generate an alert. For example, the control logic can generate an alert indicating that the force threshold has been satisfied. The control logic 600 then proceeds to step 610.

At step 610, the control logic 600 can transmit. For example, the control logic 600 can transmit the alert generated in step 608. In another embodiment, the control logic 600 can transmit the total force calculation, the force threshold, train events, forced data, or any other data. The control logic then proceeds to step 618.

At step 612, the control logic 600 can determine whether a temporal threshold has been satisfied. For example, the temporal threshold can be a particular time of day such that if the time of day matches the temporal threshold, the temporal threshold can be satisfied. In another embodiment, the temporal threshold can be a duration threshold, such that if a particular duration meets or exceeds the duration of the temporal threshold, the temporal threshold can be satisfied. If the control logic 600 determines that the temporal threshold has not been satisfied, the control logic 600 then proceeds back to step 606. If the control logic 600 determines that the first temporal threshold has been satisfied, the control logic 600 then proceeds to step 614.

At step 614, the control logic 600 can generate an alert. For example, the control logic 600 can generate an alert indicating that the temporal threshold has been satisfied. The control logic 600 then proceeds to step 616.

At step 616, the control logic 600 can transmit. For example, the control logic 600 can transmit the alert generated in step 614. In another embodiment, the control logic 600 can transmit the total force calculation, the force threshold, train events, forced data, or any other data. The control logic then proceeds to step 618.

At step 618, the control logic 600 can abrogate the directive. For example, the control logic can lift a slow order. In another embodiment, the control logic 600 can abrogate any other directive that the control logic 600 determines should be abrogated because of satisfaction of the total force threshold and/or the temporal threshold. The control logic 600 then proceeds to step 620.

At step 620, the control logic 600 can determine whether the directive was abrogated due to the temporal threshold. For example, the directive can be abrogated by the control logic 600 at steps 618 such as if the total force threshold is satisfied or if the temporal threshold is satisfied. If the control logic 600 determines that the directive was not abrogated due to satisfaction of the temporal threshold, the control logic 600 then proceeds to step 628. If the control logic 600 determines that the directive was abrogated due to satisfaction of the temporal threshold, the control logic 600 then proceeds to step 622.

Figure 7:
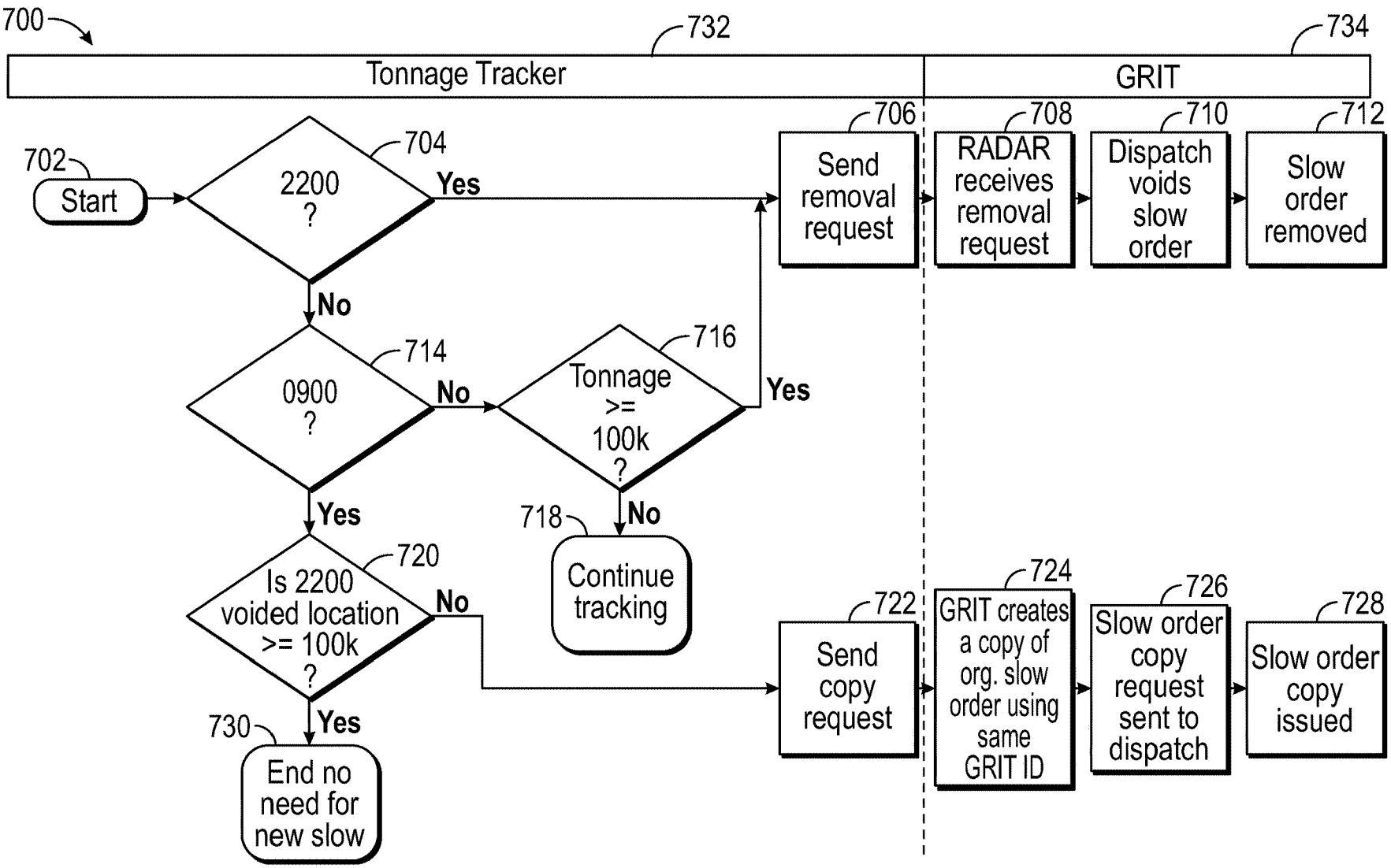
FIG. 7 illustrates a flowchart exemplifying a tonnage determination system, in accordance with one or more exemplary embodiments of the present disclosure.

FIG. 7 illustrates a flow chart diagram 700 exemplifying control logic embodying features of a tonnage determination system 700, in accordance with an exemplary embodiment of the present disclosure. The tonnage determination control logic 700 can be implemented as an algorithm on a server (e.g., server 102), a machine learning module, or other suitable system. Additionally, the tonnage determination control logic 700 can implement or incorporate one or more features of the compaction-related slow order management system 200, including the directive management system 202, the compaction tracking system 204, and the alert management system 206. The tonnage determination control logic 700 can be achieved with software, hardware, an application programming interface (API), a network connection, a network transfer protocol, HTML, DHTML, JavaScript, Dojo, Ruby, Rails, other suitable applications, or a suitable combination thereof.

The tonnage determination control logic 700 can leverage the ability of a computer platform to spawn multiple processes and threads by processing data simultaneously. The speed and efficiency of the tonnage determination control logic 700 is greatly improved by instantiating more than one process to facilitate personnel safety. However, one skilled in the art of programming will appreciate that use of a single processing thread may also be utilized and is within the scope of the present disclosure.

The tonnage determination control logic 700 process flow of the present embodiment begins at step 702, wherein the control logic 700 starts. The control logic 700 then proceeds step 704.

At step 704, the control logic 700 can determine whether the time of day is 2200 hours. In one embodiment, the time of day determine at step 704 can be any time of day or be compared with any time of day. If the control logic 700 determines that time of day is 2200 hours, the control logic 700 then proceeds to step 706. If the control logic 700 determines that the time of day is not 2200 hours, the control logic 700 then proceeds to step 714.

At step 706, the control logic 700 can send a removal request. For example, the control logic 700 can send a request for a slow order to be removed. The control logic 700 then proceeds to step 708.

At step 708, the control logic 700 can receive the removal request. For example, the control logic 700 can be in operable communication with and/or include a real time alert delivery (RADAR) mechanism (e.g., such as those known in the art) that can prompt dispatchers to conditions or situations that need immediate attention. In one embodiment, the RADAR system can receive the request. In another embodiment, the control logic 700 can include the RADAR system. The control logic 700 then proceeds to step 710.

At step 710, the control logic 700 can void the slow order. For example, the control logic 700 can receive an indication from a dispatcher to avoid the slow order. The control logic 700 then proceeds to step 712.

At step 712, the control logic 700 can remove the slow order. The control logic 700 can then terminate or repeat any of the aforementioned steps.

At step 714, the control logic 700 can determine whether the time of day is 0900 hours. In one embodiment, the time of day determine at step 704 can be any time of day or be compared with any time of day. If the control logic 700 determines that the time of day is 0900 hours, the control logic then proceeds to step 720. If the control logic 700 determined at the time of day is not 0900 hours, the control logic 700 then proceeds to step 716.

At step 716, the control logic 700 can determine whether a total tonnage, such as a tonnage associated with a particular slow order and tracked by the tonnage tracker 732, is more than or equal to 100,000 tons. In another embodiment, the total tonnage and/or tonnage threshold can be any other suitable amount. If the control logic 700 determines that the total tonnage is more than or equal to 100,000 tons, the control logic 700 then proceeds to step 706. If the control logic 700 determines that the total tonnage is less than 100,000 tons, the control logic then proceeds to step 718.

At step 718, the control logic 700 can continue to track total tonnage. For example, if the control logic 700 determines that the total tonnage is not greater than or equal to 100,000 tons, the control logic 700 can determine continue tracking the total tonnage until the force threshold at step 716 is satisfied.

At step 720, the control logic 700 can determine whether a location with an associated slow order had such slow order voided due to the control logic 700 determining satisfaction of a temporal threshold, such as step 704. If the control logic 700 determines that a slow order was voided due to the temporal threshold, such as the temporal threshold at step 704, and such as opposed to voiding of the slow order due to the total tonnage meeting a force threshold such as can be determined in step 716, the control logic 700 then proceeds to step 730. If the control logic 700 determines that the slow order was not vacated due to satisfaction of a temporal threshold, such as in step 704, the control logic 700 then proceeds to step 722.

At step 722, the control logic 700 can send a copy request. For example, the control logic 700 can determine at step 720 that the initial slow order was only abrogated due to temporal threshold satisfaction as opposed to a total for satisfaction. In one embodiment, the control logic 700 can determine that aggregation due to satisfaction of a temporal threshold can require a new slow order such as when another temporal threshold is satisfied, such as at step 714. For example, and as exemplified by the control logic 700, the control logic 700 can in this manner abrogate slow orders at night time, such as when temperatures are lower and the risk of train derailment, such as due to ballast decompaction (e.g., such as because rail temperature is lower) is lower. In another embodiment, the control logic 700 can also determine that if the slow order was only abrogated because of the time of day, that a new slow order should be copied and associated with a particular area of track because the total requisite tonnage (such as required at step 716) has not been met. In another embodiment, the control logic 700 can request that a copy of the directive initially associated with a particular location be established. In this manner, and as one example, a tonnage tracker 732 can be in operable communication with a GRIT 734, e.g., such as a GRIT known in the art. The control logic 700 then proceeds to step 724.

At step 724, the control logic 700 can cause to be created a copy of the original slow order using a similar identification. For example, the control logic can be in operable communication with a graphical user interface restriction input tool (GRIT) 734 and/or include a GRIT 734. In one embodiment, the control logic can cause the GRIT to create a direct copy of the original slow order and associate the GRIT ID of the original slow order with the new slow order such that the same tonnage from the previous slow order that had already been tracked can be carried over to the new slow order. The control logic 700 then proceeds to step 726.

At step 726, the control logic 700 can cause the slow order copy request to be sent to dispatch. For example, the control logic 700 can transmit a copy request to dispatch (and/or TMDS) such that dispatch is aware of the need to copy the slow order. The control logic 700 then proceeds to step 728.

At step 728, a slow order copy can be issued. For example, the control logic 700 can issue the slow order copy. In another embodiment, the GRIT 734 can issue a new slow order copy. In another embodiment, a slow order copy can be issued in any other suitable manner. The control logic 700 can then terminate or repeat any of the aforementioned steps.

At step 730, the control logic 700 can end. For example, the control logic 700 can determine that there is no need for a new slow order. For example, the control logic 700 can determine that while the original slow order was voided due to satisfaction of the temporal threshold at step 704, the requisite tonnage traversed the line such that the total force threshold (such as the total force threshold discussed with respect to step 716) has been satisfied. In another example, the control logic 700 can continue to track total tonnage across one or more track segments while a slow order is voided and compare such tonnage with a force threshold. The control logic 700 can then terminate or repeat any of the aforementioned steps.

Figure 8A:
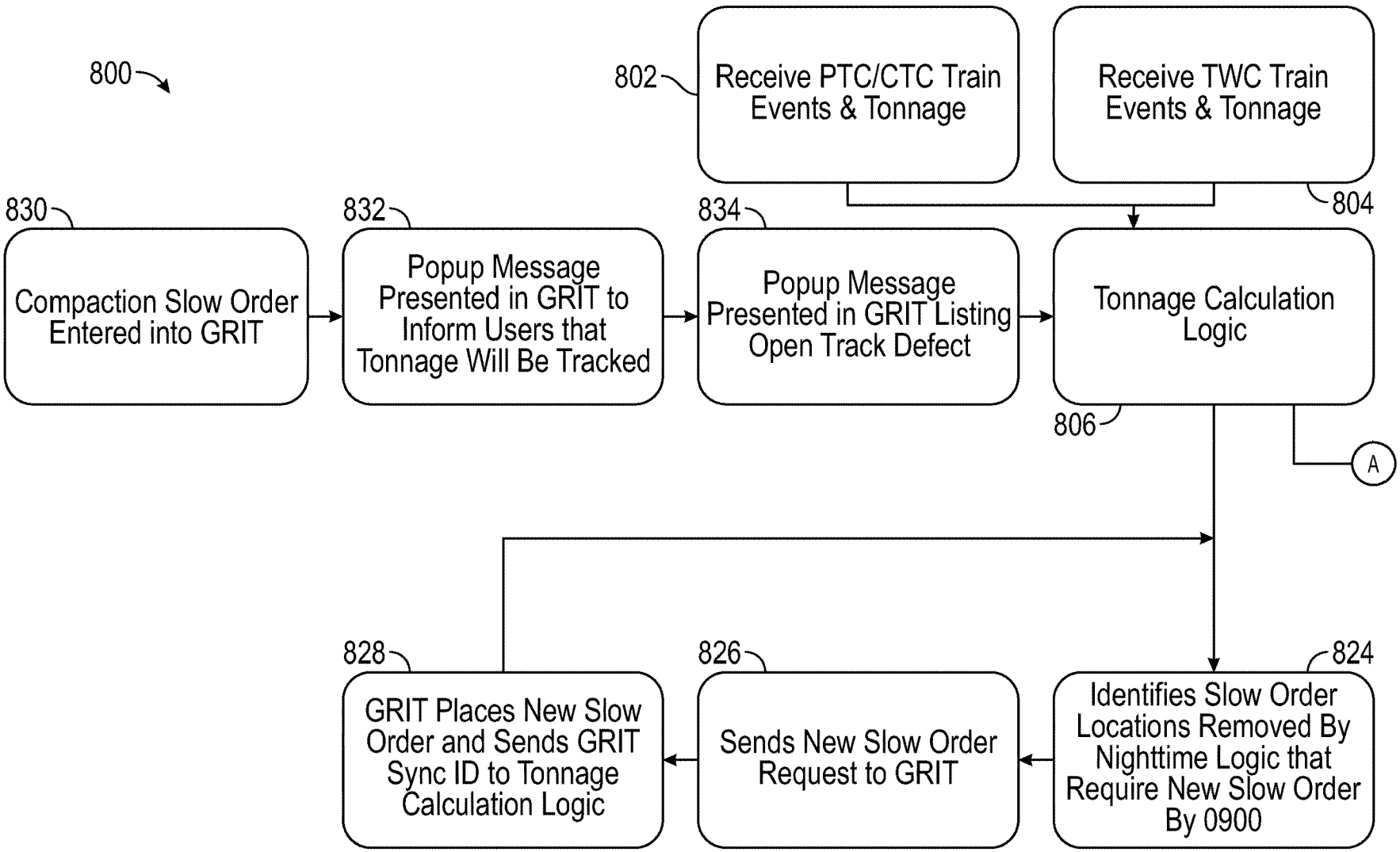
FIG. 8A illustrates a flowchart exemplifying a slow order removal system, in accordance with one or more exemplary embodiments of the present disclosure.
Figure 8B:
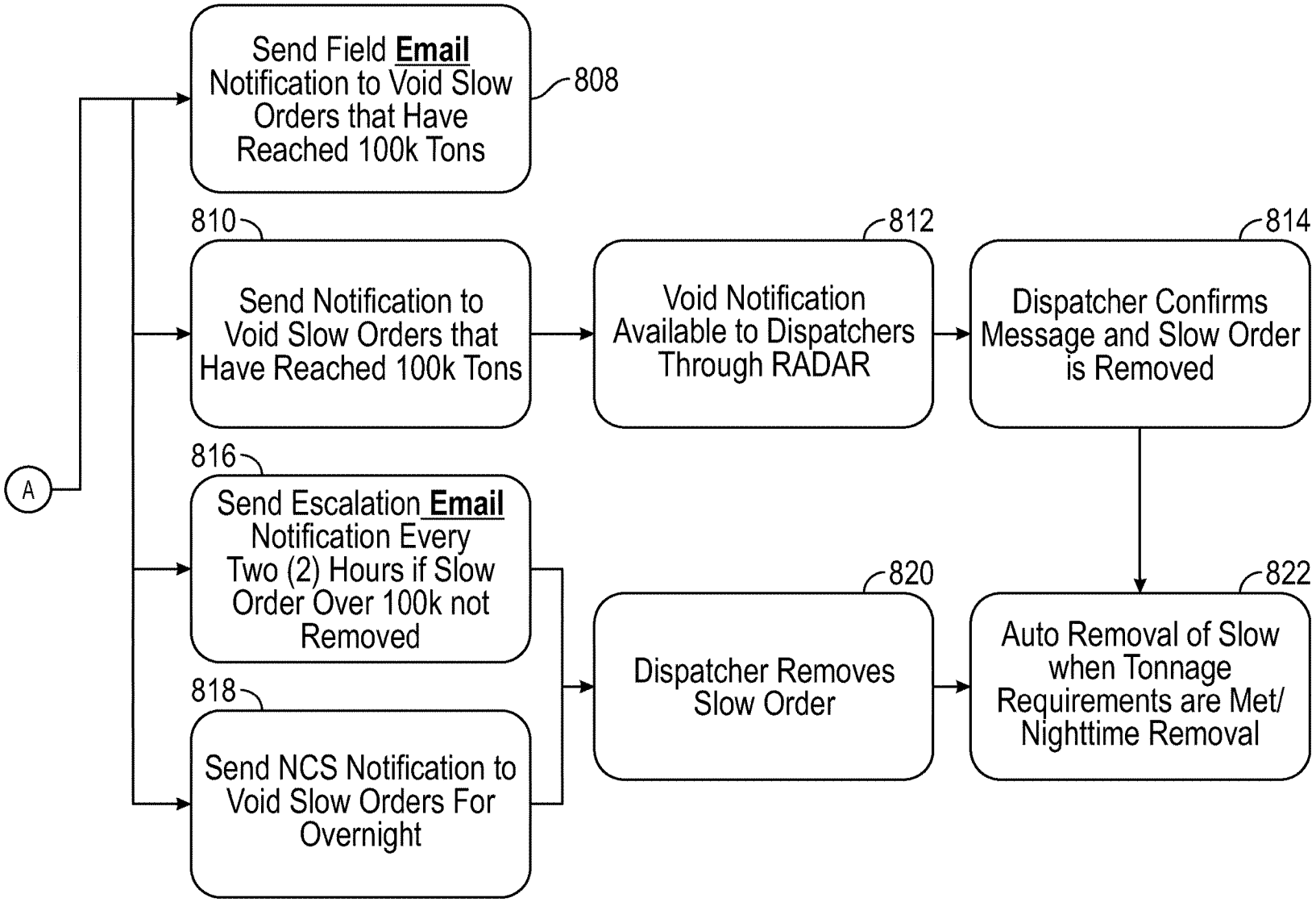
FIG. 8B illustrates a flowchart exemplifying a slow order removal system, in accordance with one or more exemplary embodiments of the present disclosure.

FIG. 8A and FIG. 8B illustrates a flow chart diagram 800 exemplifying control logic embodying features of a slow order removal system 800, in accordance with an exemplary embodiment of the present disclosure. The slow order removal control logic 800 can be implemented as an algorithm on a server (e.g., server 102), a machine learning module, or other suitable system. Additionally, the slow order removal control logic 800 can implement or incorporate one or more features of the compaction-related slow order management system 200, including the directive management system 202, the compaction tracking system 204, and the alert management system 206. The slow order removal control logic 800 can be achieved with software, hardware, an application programming interface (API), a network connection, a network transfer protocol, HTML, DHTML, JavaScript, Dojo, Ruby, Rails, other suitable applications, or a suitable combination thereof.

The slow order removal control logic 800 can leverage the ability of a computer platform to spawn multiple processes and threads by processing data simultaneously. The speed and efficiency of the slow order removal control logic 800 is greatly improved by instantiating more than one process to facilitate personnel safety. However, one skilled in the art of programming will appreciate that use of a single processing thread may also be utilized and is within the scope of the present disclosure.

The slow order removal control logic 800 begins at steps 802, 804, and 830. At step 802, the control logic 800 can receive positive train control and/or centralized traffic control train events and tonnage. The control logic 800 then proceeds to step 806.

At step 804, the control logic 800 can receive track warrant control train events and tonnage. The control logic 800 then proceeds to step 806.

At step 830, the control logic 800 can receive a compaction slow order, such as a compaction slow order entered into GRIT. The control logic 800 then proceeds to step 832.

At step 832, the control logic 800 can instantiate a pop-up message that can be presented in GRIT to inform users that tonnage will be tracked. The control logic 800 then proceeds to step 834.

At step 834, the control logic 800 can instantiate a pop-up message presented in GRIT that can list open track defects. The control logic 800 then proceeds to step 806.

At step 806, the control logic 800 can instantiate tonnage calculation logic. For example, the control logic 800 can begin to calculate total tonnage based on received tonnage data in accordance with the principles of the present disclosure. The control logic then proceeds to steps 808, 810, 816, 818, and 824.

At step 808, the control logic 800 can send a field email notification to avoid slow orders that have reached 100,000 tons. In another embodiment, the force threshold at step 808 can be any suitable tonnage. The control logic 800 can then terminate or repeat any of the aforementioned steps.

At step 810, the control logic 800 can send another notification to void slow orders that have reached 100,000 tons or some other force threshold. The control logic 800 then proceeds to step 812.

At step 812, the control logic can make available void notifications to dispatchers throughout the RADAR system. The control logic 800 then proceeds to step 814.

At step 814, the control logic 800 can receive a dispatcher confirmation message and either remove the slow order or receive an indication that the slow order has been removed. The control logic 800 then proceeds to step 822.

At step 816, the control logic 800 can send escalation email notifications at particular time intervals if a slow order with a total tonnage exceeding a force threshold has not yet been removed. The control logic 800 then proceeds to step 820.

At step 818, the control logic 800 can send notifications to void slow orders if particular temporal thresholds have been satisfied in accordance with the principles of the present disclosure. For example, the control logic 800 can send notifications toward slow orders for overnight operation. The control logic 800 then proceeds to step 820.

At step 820, a dispatcher can remove the slow order. In one embodiment, the dispatcher can remove the slow order as opposed to auto removal, e.g. at step 822. In another embodiment, the control logic 800 can utilize an auto removal such as in step 822 such that the dispatcher does not have remove the slow order manually. The control logic 800 then proceeds to step 822.

At step 822, the control logic 800 can automatically remove the slow order when the tonnage requirements are met and/or a temporal threshold (such as a night time removal protocol) is satisfied. The control logic 800 can then terminate or repeat any of the aforementioned steps.

Figure 9:
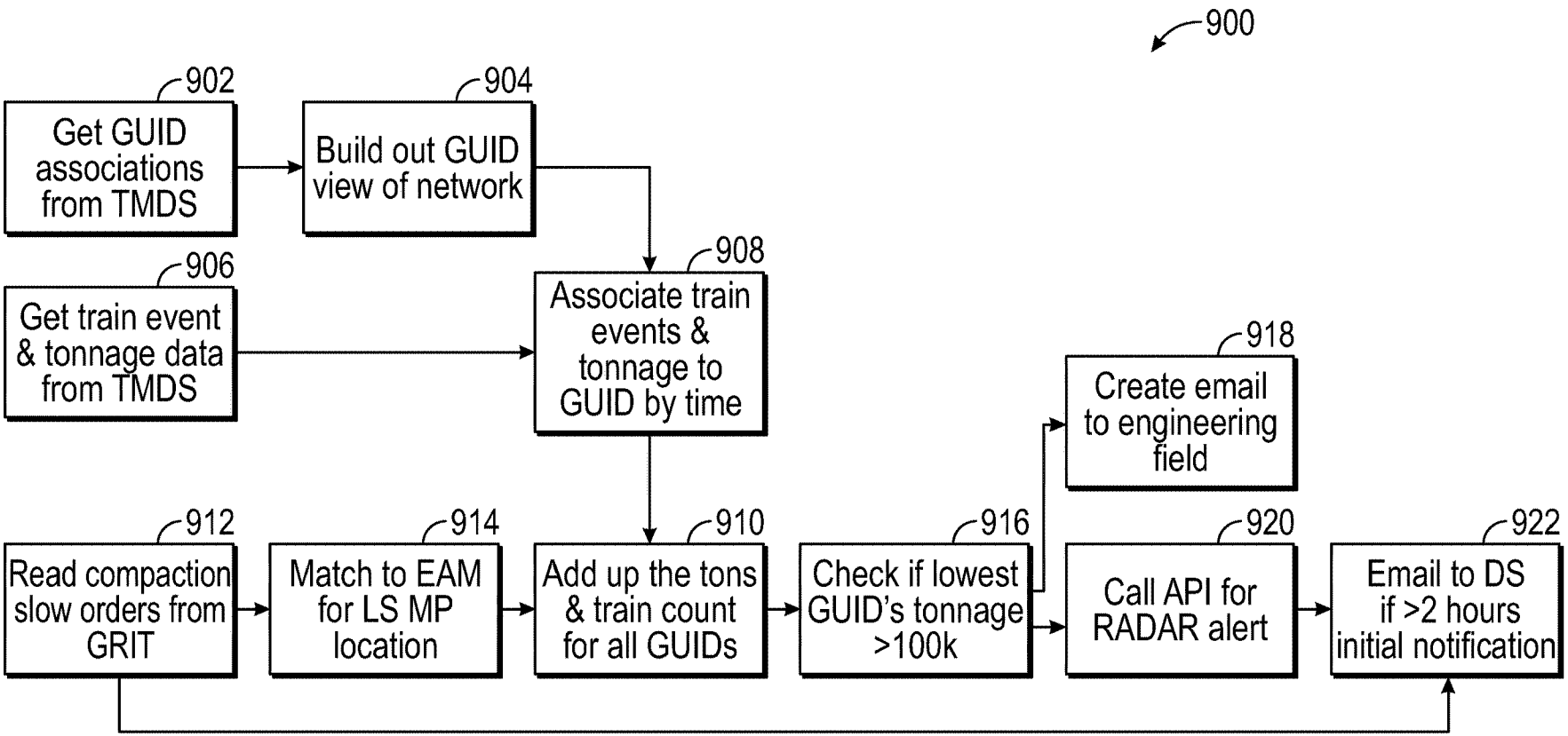
FIG. 9 illustrates a flowchart exemplifying a directive management integration system, in accordance with one or more exemplary embodiments of the present disclosure.

FIG. 9 illustrates a flow chart diagram 900 exemplifying control logic embodying features of a directive management integration system 900, in accordance with an exemplary embodiment of the present disclosure. The directive management integration control logic 900 can be implemented as an algorithm on a server (e.g., server 102), a machine learning module, or other suitable system. Additionally, the directive management integration control logic 900 can implement or incorporate one or more features of the compaction-related slow order management system 200, including the directive management system 202, the compaction tracking system 204, and the alert management system 206. The directive management integration control logic 900 can be achieved with software, hardware, an application programming interface (API), a network connection, a network transfer protocol, HTML, DHTML, JavaScript, Dojo, Ruby, Rails, other suitable applications, or a suitable combination thereof.

The directive management integration control logic 900 can leverage the ability of a computer platform to spawn multiple processes and threads by processing data simultaneously. The speed and efficiency of the directive management integration control logic 900 is greatly improved by instantiating more than one process to facilitate personnel safety. However, one skilled in the art of programming will appreciate that use of a single processing thread may also be utilized and is within the scope of the present disclosure.

The directive management integration control logic 900 process flow of the present embodiment begins at step 902, step 906, and step 912. At step 902, the control logic 900 receives GUID associations from TMDS. In one embodiment, a railroad track can be broken into segments of tracks, turnouts, and signals that allows TMDS to associate train movements to a known location. In another embodiment, these segments can have a unique identification number called a Global Unique Identifier (GUID or UID). The control logic 900 then proceeds to step 904.

At step 906, the control logic 900 can receive train event and tonnage data from TMDS. The control logic 900 then proceeds to step 908.

At step 904, the control logic 900 can build out a GUID view of the network. For example, the control logic 900 can render a track chart including one or more track segments that can each have a GUID (such as can be seen, e.g., in FIG. 11). The control logic 900 then proceeds to step 908.

At step 908, the control logic 900 can associate train events and tonnage to track segments by time. For example, the control logic 900 can associate train events and tonnage to a particular GUID that can be associated with a particular track segment. The control logic 900 then proceeds to step 910.

At step 912, the control logic 900 can read compaction slow orders from GRIT. The control logic 900 then proceeds to step 914 and step 922.

At step 922, the control logic 900 can notify dispatch if a particular amount of time has passed since initial notification was generated by the control logic 900. For example, the control logic 900 can send an email to dispatch. The control logic 900 can then terminate or repeat any of the aforementioned steps.

At step 914, the control logic 900 can match such compaction slow order read at step 912 with enterprise asset management (EAM) systems and/or solutions (e.g., such as those known in the art) or particular railroad infrastructure locations, such as for land and shoreline management plan (LSMP) locations (e.g., such as those known in the art). The control logic 900 then proceeds to step 910.

At step 910, the control logic 900 can add up the tons and train count for all track segments, such as track segments with associated GUIDS. The control logic 900 then proceeds to step 916.

At step 916, the control logic 900 can check if the lowest track segments tonnage exceeds a force threshold. For example, the control logic 900 can check if the lowest GUID'S tonnage meets or exceeds a force threshold, such as 100,000 tons. The control logic 900 then proceeds to steps 918 and 920.

At step 918, the control logic 900 can generate a notification to the engineering field. For example, the control logic 900 can create an email to the engineering field. In another example, the control logic 900 can notify the engineering field if the lowest track segments tonnage exceeded the force threshold such that the slow order can be lifted. The control logic 900 can then terminate or repeat any of the aforementioned steps.

At step 920, the control logic 900 can call an application programming interface (API) for a RADAR alert. The control logic 900 can then terminate or repeat any of the aforementioned steps.

Figure 10:
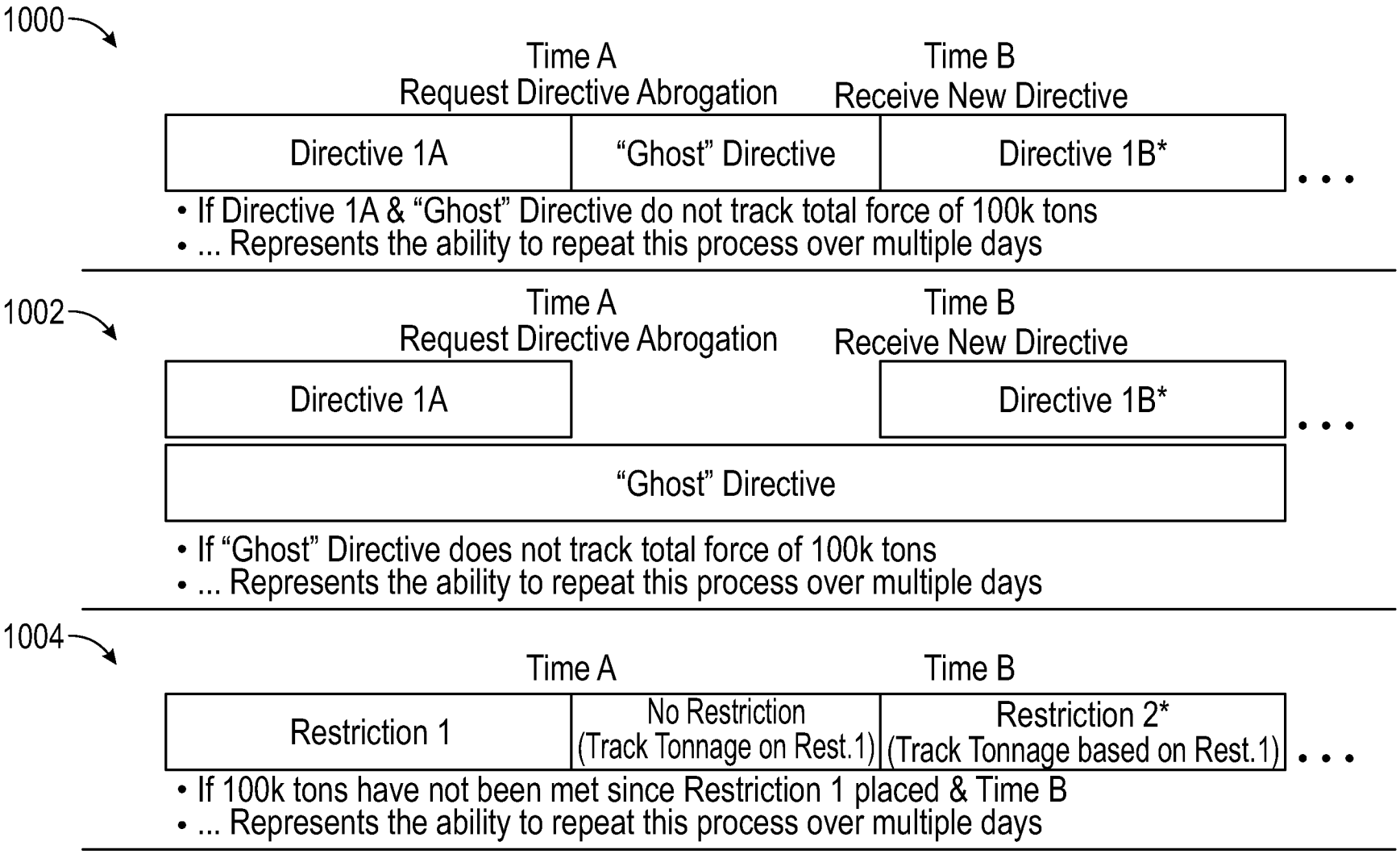
FIG. 10 illustrates a block diagram of methods of tracking a force on a track segment, in accordance with one or more exemplary embodiments of the present disclosure.

FIG. 10 illustrates a block diagram of an embodiment of the present disclosure. In one embodiment, systems and modules disclosed herein and configured to track force, temporal thresholds, force thresholds, events, etc. can abrogate a directive based on satisfaction of a first temporal threshold. In another embodiment, systems and modules disclosed herein can reinstate such directives upon satisfaction of a second temporal threshold. In another embodiment, during the time between satisfaction of the first temporal threshold and satisfaction of the second temporal threshold, systems and modules disclosed herein can be configured to continue tracking force across one or more rail segments, such that the systems and modules disclosed herein can determine whether a new directive is needed upon satisfaction of the second temporal threshold. 1000 depicts a block diagram of a first method of tracking a force on a track segment. For example, a first directive, Directive 1A, can be instated and include a force total that can be incremented with each train event (e.g., a train having a weight and traveling on a segment associated with the directive). In another example, at Time A (e.g., satisfaction of first temporal threshold), Directive 1A can be abrogated, such that the directive is no longer actively causing particular guidelines to be promulgated with respect to a particular length of track. In one embodiment, a "Ghost Directive" can be instated. For example, a ghost directive can be a directive including the force total from Directive 1A, but have no active guidelines associated with it, such that the ghost directive does not affect operation of the railroad. In another embodiment, the ghost directive can include guidelines, such as guidelines that can be different from Directive 1A. In another embodiment, at Time B (e.g., satisfaction of the second temporal threshold), Directive 1B can be instated, such as if the force total tracked by Directive 1A and the ghost directive do not satisfy a force threshold.

1002 depicts a block diagram of a second method of tracking a force on a track segment. For example, a first directive, Directive 1A, can be instated to promulgate certain instructions to a railroad with respect to a particular length of track. In one embodiment, a "Ghost Directive" can be instated at the same time as Directive 1A and include a force total that can be incremented with each train event (e.g., a train having a weight and traveling on a segment associated with the directive). In another example, at Time A (e.g., satisfaction of first temporal threshold), Directive 1A can be abrogated, such that the directive is no longer actively causing particular guidelines to be promulgated with respect to a particular length of track. In one embodiment, the ghost directive can continuously track the total force during active Directive 1A and after abrogation. In another embodiment, at Time B (e.g., satisfaction of the second temporal threshold), Directive 1B can be instated, such as if the force total tracked by the ghost directive does not satisfy a force threshold. In another embodiment, the ghost directive can continue to track total force when/if Directive 1B becomes active if the total force has not yet reached a force threshold. In another embodiment, the ghost directive can include guidelines, such as guidelines that can be different from Directive 1A and/or Directive 1B.

1004 depicts a block diagram of a third method of tracking a force on a track segment. For example, a first restriction (e.g., a speed restriction), can be instated and include a force total that can be incremented with each train event (e.g., a train having a weight and traveling on a segment associated with the directive). In another example, at Time A (e.g., satisfaction of first temporal threshold), the first restriction can be lifted, such that the first restriction is no longer limiting, e.g., a speed, on a particular portion of track. In one embodiment, the restriction can be lifted, and a force total can continue to be tracked, such as with respect to the first restriction. In another embodiment, at Time B (e.g., satisfaction of the second temporal threshold), a second restriction can be instated, such as if the force total tracked by the first directive did not satisfy a force threshold.

Figure 11:
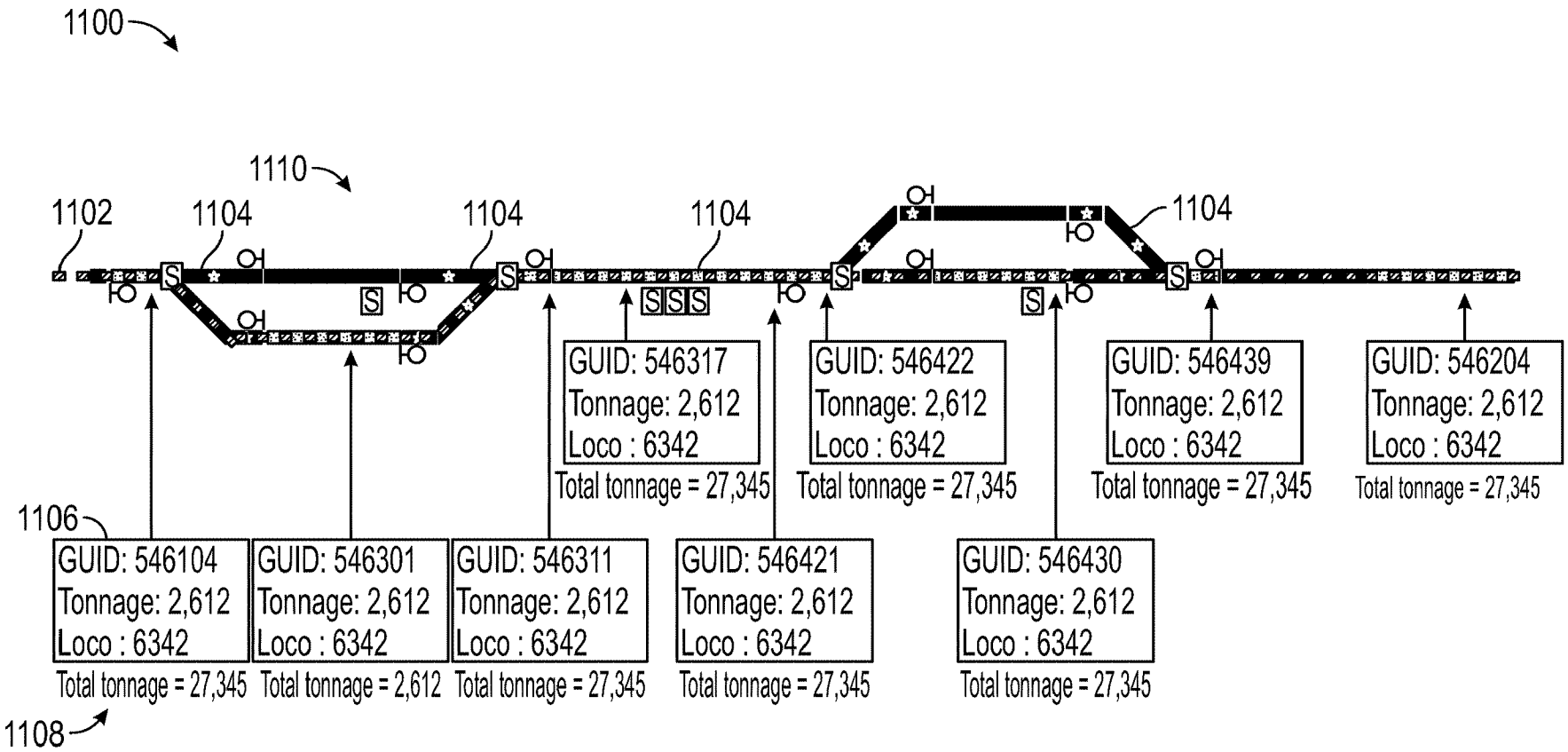
FIG. 11 illustrates an exemplary rendering of a directive management track chart in accordance with one or more exemplary embodiments of the present disclosure.

FIG. 11 depicts another embodiment of the present disclosure. A directive management track chart 1100 can include a rendering of a railroad track 1110. In one embodiment, the track chart 1100 can include one or more track segments 1104. In another embodiment, each track segment can include segment-specific information 1106 associated with it. In one example, the information 1106 associate with each segment 1104 can include an identification number (e.g., "GUID"), the last force determined on that segment and/or being applied to the segment (e.g., "Tonnage"), and/or vehicle identification information related to the last train to have been on that segment and/or currently on the segment (e.g., "Loco"). In another embodiment, each segment 1104 can include a total force count (e.g., "Total tonnage"). For example, the total force count for each segment 1104 can change as force is applied to the track. For example, as vehicle 6342 travels over segment 546104, and if vehicle 6342 includes a tonnage of 2,612, the total force count for segment 546104 can includes by 2,612 to arrive at 27,345. In another embodiment, segment 546301 can have a total force count of zero prior to vehicle 6342 traversing it, such that the total force count for segment 546301 can increase to 2,612 (the tonnage of vehicle 6342) as vehicle 6342 passes thereon.

In another embodiment, the track chart 1100 can exemplify tracing capabilities of the present disclosure, e.g., like those discussed with respect to tracing module 130. For example, each of the segments 1104 in the track chart 1100 can indicate whether it has been traveled on by a vehicle or is currently hosting a vehicle. In one embodiment, such information can be reflected by the track chart 1100, such as via color emphasis. For example, track segments 1104 reporting vehicle presence can be a lighter color, and track segments 1104 that are silent and/or report no vehicle presence can be a darker color. In one embodiment, systems and modules in accordance with the present disclosure can utilize track segment 1104 data to trace a vehicle path 1102. In a specific example illustrated by FIG. 11, track segment 546104 can be reporting a vehicle presence, which can be emphasized by a lighter color of such segment. However, neither of the track segments immediately adjacent to segment 546104 are, in this example, reporting a vehicle presence. However, segment 546301 is reporting a vehicle presence as indicated by the lighter color. In one embodiment, systems and modules in accordance with the present disclosure can utilize such data points to trace a vehicle path 1102, such as despite inconsistent segment 1104 reporting due to, e.g., track current irregularities, faulty sensors, etc.

The present disclosure achieves at least the following advantages:

1. Maximizing rail throughput by tracking force and/or events with respect to directives;
2. Enhancing safety by enabling segment-specific data collection and aggregation with individualized comparisons to one or more thresholds;
3. Providing systems and methods for directive management that utilize mass data collected with respect to train events;
4. Enhancing compaction tracking by accounting for total force, environmental conditions, and specific events on a per-segment basis; and
5. Maximizing efficiency via automatic directive modification in response to algorithmic cluster thresholding.

Persons skilled in the art will readily understand that these advantages (as well as the advantages indicated herein) and objectives of this system would not be possible without the particular combination of computer hardware and other structural components and mechanisms assembled in this inventive system and described herein. It will be further understood that a variety of programming tools, known to persons skilled in the art, are available for implementing the control of the features and operations described in the foregoing material. Moreover, the particular choice of programming tool(s) may be governed by the specific objectives and constraints placed on the implementation plan selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f).

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A system for modifying railroad directives, comprising:

a memory having a database with a plurality of data, thresholds, and specifications related to railroad tracks and at least one asset; and a processor operably coupled to the memory and capable of executing machine-readable instructions to perform program steps, the program steps including:

receiving directive data and track data related to a track;

identifying, via the processor, a plurality of track segments associated with the track data;

associating the directive data with at least a first track segment of the plurality of track segments, wherein the directive data includes a restriction imposed on the at least a first track segment;

identifying, via the processor, an asset disposed on the track;

receiving asset data and positional data points related to the asset;

receiving environmental data related to the track;

determining event criteria related to one or more event types;

determining, via the processor, a path of the asset along one or more track segments of a railroad track using the positional data points;

determining if the path or at least one of the positional data points traverses the at least a first segment associated with the directive data;

determining whether the environmental data satisfies a first environmental threshold;

determining whether an event threshold is satisfied indicating that an event count associated with the one or more event types exceeds a threshold count; and instantiating a directive modification in response to one or more of determining whether the environmental data satisfies the first environmental threshold and determining whether the event threshold is satisfied, wherein instantiating the directive modification includes modifying the restriction imposed on the at least a first track segment based on one or more of: whether the environmental data satisfies the first environmental threshold and whether the event threshold is satisfied, wherein the directive modification is configured to maximize asset throughput on the at least a first track segment.

2. The system of claim 1, wherein the program steps further include associating the directive data with a second track segment of the plurality of track segments.

3. The system of claim 2, wherein the environmental data includes a rail temperature or an ambient temperature that can affect rail temperature.

4. The system of claim 1, wherein if the environmental data indicates a particular temperature, the environmental threshold can be a particular temperature such that if the environmental data meets or exceeds a particular temperature, the environmental threshold can be satisfied.

5. The system of claim 1, wherein the program steps further include comparing an event count with the event threshold to determine whether the event threshold is satisfied.

6. The system of claim 1, wherein the directive data includes a slow order.

7. The system of claim 1, wherein the directive data includes a compaction slow order.

8. The system of claim 1, wherein the directive modification includes at least one of modifying a maximum speed of a slow order, terminating the directive, modifying the directive to include additional instructions, modifying the directive to remove instructions, and modifying the directive to require maintenance.

9. The system of claim 1, wherein the program steps further include determining whether the environmental data satisfies a second environmental threshold.

10. The system of claim 1, wherein the program steps further include generating, via the processor, an alert and transmit the alert to a railroad system.

11. A method of modifying railroad directives, comprising:

receiving, via an encrypted network, directive data and track data related to a track;

identifying, via the processor, a plurality of track segments associated with the track data;

associating the directive data with at least a first track segment of the plurality of track segments, wherein the directive data includes a restriction imposed on the at least a first track segment;

identifying, via the processor, an asset disposed on the track;

receiving asset data and positional data points related to the asset;

receiving environmental data related to the track;

determining event criteria related to one or more event types;

determining, via the processor, a path of the asset along one or more track segments of a railroad track using the positional data points;

determining if the path or at least one of the positional data points traverses the at least a first segment associated with the directive data;

determining whether the environmental data satisfies a first environmental threshold;

determining whether an event threshold is satisfied indicating that an event count associated with the one or more event types exceeds a threshold count; and instantiating, via the processor, a directive modification in response to one or more of determining whether the environmental data satisfies the first environmental threshold and determining whether the event threshold is satisfied, wherein instantiating the directive modification includes modifying the restriction imposed on the at least a first track segment based on one or more of: whether the environmental data satisfies the first environmental threshold and whether the event threshold is satisfied, wherein the directive modification is configured to maximize asset throughput on the at least a first track segment.

12. The method of claim 11, wherein the program steps further include associating the directive data with a second track segment of the plurality of track segments.

13. The method of claim 12, wherein the environmental data includes a rail temperature or an ambient temperature that can affect rail temperature.

14. The method of claim 11, wherein if the environmental data indicates a particular temperature, the environmental threshold can be a particular temperature such that if the environmental data meets or exceeds a particular temperature, the environmental threshold can be satisfied.

15. The method of claim 11, wherein the program steps further include comparing an event count with the event threshold to determine whether the event threshold is satisfied.

16. The method of claim 11, wherein the directive data includes a slow order.

17. The method of claim 11, wherein the directive data includes a compaction slow order.

18. The method of claim 11, wherein the directive modification includes at least one of modifying a maximum speed of a slow order, terminating the directive, modifying the directive to include additional instructions, modifying the directive to remove instructions, and modifying the directive to require maintenance.

19. The method of claim 11, wherein the program steps further include determining whether the environmental data satisfies a second environmental threshold.

20. The method of claim 11, wherein the program steps further include generating, via the processor, an alert and transmit the alert to a railroad system.

* * * * *